US010576009B2

(12) United States Patent
Richter et al.

(10) Patent No.: US 10,576,009 B2
(45) Date of Patent: Mar. 3, 2020

(54) MOBILITY DEVICE

(71) Applicant: Mobilix, Inc., Belmont, CA (US)

(72) Inventors: Schirin Lucie Richter, Belmont, CA (US); Lawrence G. Schubert, Belmont, CA (US); Nicholas Steigmann, Oakland, CA (US); Maiya Jensen, San Francisco, CA (US)

(73) Assignee: Mobilix, Inc., Belmont, CA (US)

( * ) Notice: Subject to any disclaimer, the term of this patent is extended or adjusted under 35 U.S.C. 154(b) by 10 days.

(21) Appl. No.: 15/558,074

(22) PCT Filed: Mar. 21, 2016

(86) PCT No.: PCT/US2016/023465
§ 371 (c)(1),
(2) Date: Sep. 13, 2017

(87) PCT Pub. No.: WO2016/149707
PCT Pub. Date: Sep. 22, 2016

(65) Prior Publication Data

US 2018/0098902 A1 Apr. 12, 2018

Related U.S. Application Data

(60) Provisional application No. 62/135,632, filed on Mar. 19, 2015.

(51) Int. Cl.
*A61H 3/00* (2006.01)
*A63B 71/00* (2006.01)
(Continued)

(52) U.S. Cl.
CPC ..... *A61H 3/00* (2013.01); *A61G 7/1038* (2013.01); *A63B 71/0009* (2013.01);
(Continued)

(58) Field of Classification Search
CPC .... A61H 3/00; A61H 3/02; A61H 2201/1635; A61H 2003/0205; A61H 2003/0272;
(Continued)

(56) References Cited

U.S. PATENT DOCUMENTS 2,195,034 A 3/1940 Miller
2,244,869 A * 6/1941 Everest ..... A61H 3/04 135/68

(Continued)

FOREIGN PATENT DOCUMENTS

DE 202004008364 11/2004
GB 2136290 A * 9/1984 ..... A61H 3/00

OTHER PUBLICATIONS

PCT/US2016/023465 , "International Search Report and Written Opinion", dated Aug. 19, 2016, 15 pages.

(Continued)

*Primary Examiner* — Winnie Yip
(74) *Attorney, Agent, or Firm* — Kilpatrick Townsend & Stockton LLP

(57) ABSTRACT

A mobility device designed to extend the usable field of movement for people with physical limitations by allowing them to descend to the ground and ascend to an upright position with ease. A user may bring the device within their vicinity, grab onto the articulating handles and safely reach the ground to engage in a ground activity. When the ground activity is completed, the user simply grabs onto the sloping handholds and ascends step-by-step until they have made their way to a standing position. The device is portable and can be stowed around the home. It is likely to be close to the user at all times, thus it is a safe means of ensuring support when a caretaker is not present.

15 Claims, 14 Drawing Sheets

(51) Int. Cl.
*A61G 7/10* (2006.01)
*A63B 22/00* (2006.01)
*A63B 21/00* (2006.01)
*A61H 3/02* (2006.01)

(52) U.S. Cl.
CPC ..... *A61H 2003/0205* (2013.01); *A63B 21/00047* (2013.01); *A63B 21/4035* (2015.10); *A63B 2022/0094* (2013.01); *A63B 2208/0214* (2013.01); *A63B 2210/50* (2013.01)

(58) Field of Classification Search
CPC .. A61H 2201/0119; A61G 5/14; A61G 5/125; A61G 7/10; A61G 7/053; A61G 7/1038; A63B 21/40; A63B 21/4035; A63B 2022/0094; A63B 21/00047; A63B 71/0009
USPC ..... 135/65–68, 72, 74, 76, 77, 80; 5/662, 5/81.1 R, 83.1; 297/56, 118, 129; 482/66, 68, 75
See application file for complete search history.

(56) References Cited

U.S. PATENT DOCUMENTS 3,999,565 A 12/1976 Delacour et al.
4,062,372 A * 12/1977 Slusher ..... A45B 3/00 135/66
4,106,521 A 8/1978 Thomas
4,159,110 A * 6/1979 Dodenhoff ..... A61H 3/04 135/67
4,860,404 A 8/1989 Flachs
5,385,163 A * 1/1995 Fairchild ..... A45B 3/00 135/65
5,746,236 A * 5/1998 Tilsley ..... A61H 3/02 135/66
5,787,913 A * 8/1998 Li ..... A61H 3/00 135/67
6,006,403 A 12/1999 Battiato
6,044,507 A * 4/2000 Smith ..... A61G 7/1038 248/158
6,170,501 B1 * 1/2001 Cook ..... A61G 7/1038 135/67
7,261,113 B2 * 8/2007 Tartaglia ..... A45B 1/02 135/66
7,363,931 B2 * 4/2008 Weaver ..... A61G 7/1038 135/66
7,938,413 B2 * 5/2011 Anderson ..... B62K 3/002 135/65
8,146,615 B1 * 4/2012 Rodriguez ..... A61H 3/02 135/66
8,919,362 B1 * 12/2014 Mortenson ..... A45B 9/04 135/66
9,038,647 B1 * 5/2015 Scott ..... A61H 3/02 135/73
2008/0029138 A1 * 2/2008 Foote ..... A61H 3/00 135/67
2012/0032491 A1 * 2/2012 Bergkvist ..... A47D 1/02 297/445.1
2012/0042918 A1 * 2/2012 Tessier ..... A45B 1/00 135/67
2013/0025641 A1 * 1/2013 Goldman ..... A61H 3/04 135/67

OTHER PUBLICATIONS

Systemromedic , "Handicare SystemRoMedic ReTurn 7500", https://youtu.be/hhCnbkmbEzo, Jan. 2, 2014, 1 page.

* cited by examiner

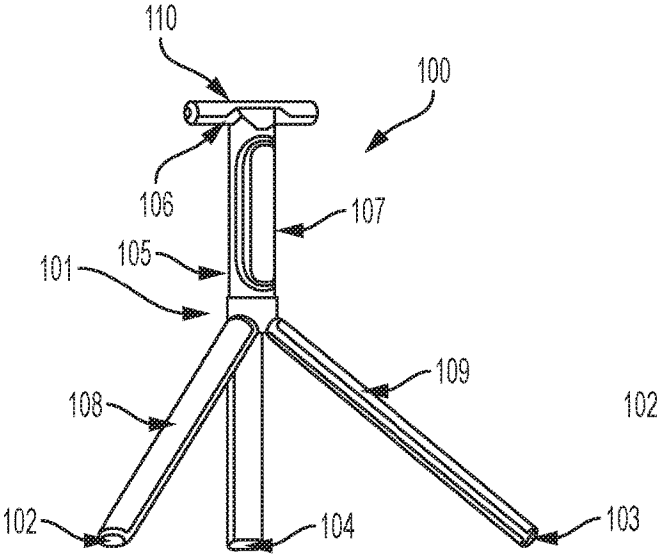
FIG. 1A
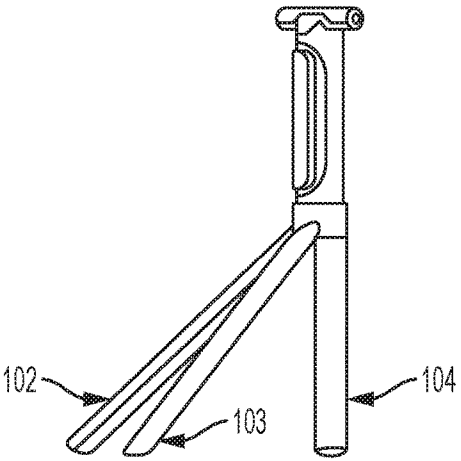
FIG. 1B
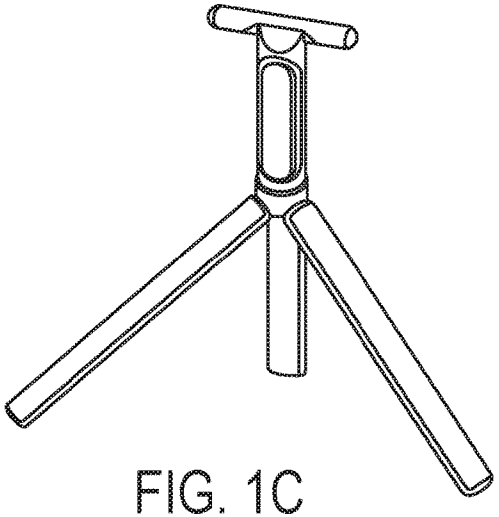
FIG. 1C
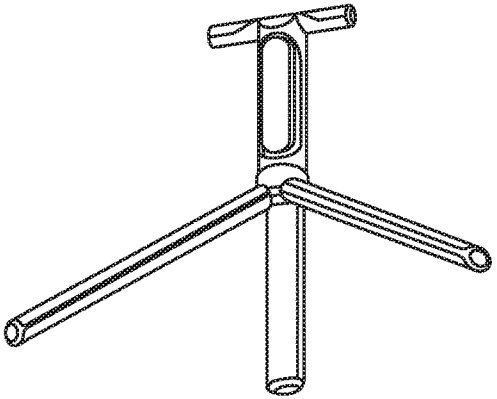
FIG. 1D
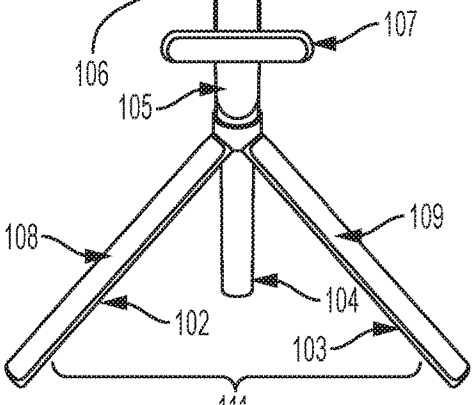
FIG. 1E
FIG. 1F

MOBILITY DEVICE

CROSS-REFERENCES TO RELATED APPLICATIONS

This application claims the benefit of priority under 35 U.S.C. § 119(e) to U.S. Provisional Patent Application No. 62/135,632, entitled "MOBILITY DEVICE," filed Mar. 19, 2015, the disclosure of which is incorporated herein by reference in its entirety for all purposes.

FIELD OF THE INVENTION

Embodiments of the invention pertain to devices for mobility, and in particular for assistance with transitioning back and forth between a standing position and a position lying, sitting or kneeling on the floor or ground.

BACKGROUND OF THE INVENTION

Existing aids for getting up from the floor require money, people to come help, and cannot be utilized by individuals with physical limitations on their own terms in everyday life. They require the presence and reliance of others who can lend assistance, which in turn can increase the decline of their physical ability because of their increased sense of reliance. They do not empower individuals with physical limitations with a sense of independence and confidence to get down on the floor or ground with confidence they can get back up again. Getting down to the ground involves physical constraints, but is also enormously driven by emotional barriers from fear of falling or being stuck on the ground. As a result, the quality of life for many older individuals or those with physical limitations suffers because they avoid engaging in activities that involve getting down on the ground from the fear that they will not be able to get back up again. They can quickly become sedentary if they do not maintain their mobility practices. Many activities in day to day life require getting onto the ground, including activities such as getting down on the ground in a sitting, kneeling or lying position, for example, to play with your grandchildren, kneeling to garden, going to the grocery store or other public places where you are especially vulnerable that require kneeling or reaching low areas.

BRIEF SUMMARY OF IRE INVENTION

The present invention seeks to provide a solution to this problem by providing a sturdy structure to help individuals get up from or get down to the floor or ground securely and safely on their own. The present device enables individuals, for example, older or physically limited people to reclaim the floor, letting go of the fear of getting down on the ground. With the device, these individuals to have confidence that they can get up again based on their own physical abilities. The device not only encourages its users to engage in activities that benefit them emotionally but it also reinforces proper muscle extensions that can help keep them fit and active. Fear of falling may in turn lead to increased risk of falls. This device encourages users to practice how to get up and down from the floor, and to do so correctly while engaging the correct muscle groups. As a result, users may reduce the risk of falls and extend their mobile years.

Traditional mobility devices can be stigmatizing and can deny their users independence in operation and in lifestyle. Independence and a safe, mobile lifestyle can be facilitated by the use of a mobility device that is safe, sturdy and has logical operation, the continual engagement and practice in activities that promote proper muscle extension, social activities, and a healthy amount of physical exertion. While some devices have been developed to help the user up from a fall, these devices seldom work because they are not accessible when the user needs to access them, may require multiple caretakers to assist the user, are stigmatizing, are large and expensive, and most importantly they do not extend the range of mobility for individuals with physical limitations. Institutions that care for older individuals or those with physical limitations have long sought a device that trains the physically limited individual to engage in proper muscle use, e.g., extension when getting up and down from the ground, thereby training the physically limited individual's body to be more resilient, prevent falling in the future, and decrease the need for caretakers when the physically limited individual wants to perform an activity on the ground. The elderly have sought a mobility device that empowers them instead of stigmatizing them, allows them to engage in hobbies and activities that they would otherwise avoid due to fear, and get them up wherever they may be, without explicitly requiring the help of a caretaker.

Thus, in one aspect, a device is provided for assisting a user to move back and forth between a down position in which the user is lying, sitting, or kneeling on a floor and a standing position in which the user is supported by the user's feet on the floor. The device includes a free-standing support structure configured to support the user's body weight and to resist horizontal and vertical displacement while the user moves between the down position and the standing position. The device further includes a plurality of handholds coupled to the support structure, the handholds being spaced apart vertically and configured for supporting the user's hands such that the user can ascend or descend between the down position and the standing position by engaging grasping the handholds. At least a first of the handholds is in a low position to allow the user to push downwardly thereon while in the down position, and at least a second of the handholds is in a high position to allow the user to push downwardly thereon while in the standing position. The first of the handholds includes a pair of handholds spaced horizontally apart with portions sloped relative to the floor to allow the user to gradually ascend from the down position on the floor to the second of the handholds and gradually descend from the second of the handholds to the down position on the floor.

In many embodiments of the device, the support structure includes a base portion configured to rest on the floor and a frame extending vertically upward from the base portion. In some embodiments of the device, the first of the handholds are coupled to the base portion, and the second of the handholds is coupled to the frame. In some embodiments of the device, the base portion and the frame comprise a substantially singular, continuous, and rigid structure made from the same material.

In many embodiments of the device, the base portion is movable from a collapsed configuration to a deployed configuration, wherein the device is configured to be compact and portable when the base portion is in the collapsed configuration. In some embodiments of the device, the device is configured to support the user's body weight and to resist horizontal and vertical displacement when the base portion is in the deployed configuration.

In many embodiments of the device, the base portion comprises three legs forming a tripod, wherein the pair of handholds comprising the first handholds are disposed on two of the three legs. In some embodiments of the device, the three legs forming the tripod are movable from a collapsed position to a deployed configuration. In some embodiments of the device, the three legs are movable from the collapsed position to a deployed configuration by actuation of a deploying button. In some embodiments of the device, the three legs forming the tripod are coupled to a collapsible material, wherein the three legs forming the tripod provide tension to the collapsible material when in the deployed configuration. In some embodiments of the device, the three legs forming the tripod are coupled together by a single cable, wherein the cable is configured to provide tension to stabilize tripod in the deployed configuration.

In another aspect, a device is provided for assisting a user to move between a down position in which the user is lying, sitting, or kneeling on a floor and a standing position in which the user is supported by the user's feet on the floor. The device includes a portable, free-standing support structure movable from a collapsed configuration to a deployed configuration, the support structure being configured to support the user's body weight and to resist horizontal and vertical displacement in the deployed configuration, the support structure having a size, weight, and geometry in the collapsed configuration selected to allow it to be carried by the user without assistance. The device further includes a plurality of handholds coupled to the support structure, the handholds being spaced apart vertically and configured for supporting the user's hands such that the user can ascend or descend between the down position and the standing position by pushing or pulling on the handholds. At least a first of the handholds is in a low position to allow the user to push downwardly thereon while in the down position, and at least a second of the handholds is in a high position to allow the user to push downwardly thereon while in the standing position.

In many embodiments of the device, the support structure includes a base configured to provide a stable platform on the floor, and a frame extending upwardly from the base. In some embodiments, the base is movable from a collapsed configuration to a deployed configuration. In some embodiments, the base comprises a plurality of base elements movably coupled together. In some embodiments, the base forms a tripod in the deployed configuration. In some embodiments, the frame comprises a vertical member extending upwardly from the base. In some embodiments, at least a portion of the handholds are coupled to the vertical member. In some embodiments, the handholds comprise horizontal rungs mounted transversely on the vertical member. In some embodiments, the rungs are movable relative to the vertical member. In some embodiments, the rungs have a rung locking mechanism for locking the rungs in position relative to the vertical member. In some embodiments, the tripod has a pair of front frame members and a back frame member, the pair of front frame members being configured to support the user's hands in horizontally spaced apart positions and allow the user to push their body upward relative to the front frame members. In some embodiments, the pair of front frame members each comprises a pad or grip-enhancing material thereon. In some embodiments, the handholds are coupled to the frame members of the tripod. In some embodiments, the handholds comprise rungs mounted transversely on the frame members. In some embodiments, the handholds comprise grippable regions on the frame members. In some embodiments, the grippable regions comprise a pad or grip-enhancing material on the frame members. In some embodiments, the tripod has a pair of front frame members and a back frame member. In some embodiments, the handholds are coupled to the front frame members in horizontally spaced apart positions configured to support the users hands simultaneously to allow the user to push their body upward relative to the front frame members. In some embodiments, the device further includes a vertical member extending upwardly from an apex of the tripod, the vertical member having at least one handhold thereon. In some embodiments, the handhold comprises a first rung mounted transversely on the vertical member. In some embodiments, the device further includes at least a second rung mounted to the vertical member and spaced vertically from the first rung. In some embodiments, the vertical member is rigidly attached to the back frame member. In some embodiments, the vertical member is integrally formed with the back frame member.

In many embodiments of the device, the device further includes a support locking mechanism for locking the support structure in the deployed configuration. In some embodiments, the device further includes a release mechanism to release the support structure from the deployed configuration.

In many embodiments of the device, the support structure comprises a plurality of frame members movably coupled to each other. In some embodiments, the support structure forms a tripod in the deployed configuration. In some embodiments, the frame members are coupled together at an apex of the tripod, the apex being at a height in the deployed configuration which is at least as high as the user's knee when in the standing position. In some embodiments, the apex is at least 23 centimeters from the floor in the deployed configuration.

In many embodiments of the device, the handholds may be have specific heights above the floor. In some embodiments, the first handhold is at most about 55 cm above the floor in the deployed configuration. In some embodiments, the second handhold is at least about 85 cm above the floor in the deployed configuration. In some embodiments, two handholds are disposed at the same height above the floor and horizontally spaced apart in the deployed configuration.

In another aspect, a device is provided for assisting a user to move between a down position in which the user is lying, sitting, or kneeling on a floor and a standing position in which the user is supported by the user's feet on the floor. The device includes a portable, free-standing support structure having a support post and first and second legs pivotably coupled to the support post at a pivot point, each leg being movable between a storage position nested alongside the support post and a deployed position extending at an acute angle from the support post, the support post and each leg having a lower end configured to engage the floor, the legs and the support post forming in the deployed position a stable base configured to resist tipping and sliding relative to the floor. The device further includes a first handhold disposed on the first leg and a second handhold disposed on the second leg, the first and second handholds being configured to support the user's hands and allow the user to push against the first and second legs in a downward direction without tipping the support structure. The device further includes an upper member extending upwardly above the pivot point, and at least a first ring mounted to the upper member in a horizontal orientation and configured to allow the user pull or push downwardly on the rung without tipping the support structure.

In many embodiments of the device, the device further includes a second rung mounted to the vertical member in a horizontal orientation and configured to allow the user to pull or push on the rung in a generally vertical direction without tipping the support structure. In many embodiments of the device, the vertical member is integrally formed with the post. In many embodiments of the device, the first rung is movably mounted to the vertical support. In many embodiments of the device, the first and second handholds have a pad or grip-enhancing material mounted thereto.

In many embodiments of the device, the device further includes a locking mechanism for locking the first and second legs in the deployed position. In some embodiments, the device further includes a release mechanism for releasing the first and second legs from the deployed position.

In many embodiments of the device, the support post comprises third and fourth legs spaced apart from each other. In some embodiments, the support post comprises a U-shaped frame having third and fourth legs. In some embodiments, the first and second legs are pivotally coupled to the U-shaped frame. In some embodiments, the first and second legs are attached to a horizontal member extending between the third and fourth legs.

In many embodiments of the device, the upper member is rigidly attached to the support post. In some embodiments, the upper member is integrally formed with at least a portion of the support post.

In another aspect, a device is provided for assisting a user to move between a down position in which the user is lying, sitting, or kneeling on a floor and a standing position in which the user is supported by the user's feet on the floor. The device includes a u-shaped frame including first and second support legs and a first horizontal member extending between the first and second support legs. The device further includes a pivoting arm rotatably coupled to the u-shaped frame, wherein the pivoting arm includes third and fourth support legs extending from a second horizontal member, the third and fourth support legs angled outwardly relative to each other such that a distance between a lower end of the third support leg and a lower end of the fourth support leg is greater than a distance between an upper end of the third support leg and an upper end of the fourth support leg. The pivoting arm rotates relative to the u-shaped frame from a collapsed configuration in which the third and fourth support legs are lined up with the first and second support legs to a deployed configuration in which the third and fourth support legs are laterally spaced apart from the first and second support legs such that the device freely stands on the floor. The device is configured to support the user's body weight and to resist horizontal and vertical displacement in the deployed configuration, and further includes a pair of sloping handholds disposed on the third and fourth support legs, an intermediate horizontal handhold disposed on the second horizontal member, and an upper handhold disposed on the first horizontal member. Each of the handholds may be spaced apart vertically and configured for supporting the user's hands such that the user can ascend or descend between the down position and the standing position by pushing or pulling on the handholds.

In many embodiments of the device, the device further includes a third horizontal member extending between the first and second support legs at a height above the second horizontal member and below the first horizontal member, and a second intermediate handhold disposed on the third horizontal member.

In many embodiments of the device, the device further includes a pad material coupled to the lower ends of the third and fourth support legs, the pad material being configured to rest on the floor when the device is in the deployed position so as to provide a soft support surface for the user. In some embodiments, the pad material is rotatably coupled to the third and fourth support legs such that the pad material can rotate from a first position parallel to the third and fourth support legs to a second position at an angle with respect to the third and fourth support legs, wherein the pad material rests on the floor in the second position.

In another aspect, a method is provided for using a device comprising a free-standing support structure and a plurality of handholds coupled to the support structure to move from a standing position in which a user is supported by the user's feet on the floor to a down position in which the user is lying, sitting, or kneeling on a floor. The method includes engaging a first horizontal handhold and pressing downwardly on the first horizontal handhold with one or both hands, moving at least one hand from the first horizontal handhold to engage an intermediate horizontal handhold disposed below the first horizontal handhold, lowering an upper portion of the user's body to conform with the user's hand positioning on the handhold, and moving at least one hand from the intermediate handhold to engage an upper portion of a first sloping handhold. The method further includes lowering a first knee to the floor, moving a second hand to engage an upper portion of a second sloping handhold, lowering a second knee to the floor, and gradually descending both hands down the sloping handholds and conforming the user's body to a desired position on the floor.

In some embodiments, the method further includes facing the device prior to engaging the first horizontal handhold. In some embodiments, the method further includes moving the device to a deployed configuration prior to engaging the first horizontal handhold. In some embodiments, lowering the first and second knees includes lowering the first and second knees to a position in between the first and second sloping handholds.

BRIEF DESCRIPTION OF THE DRAWINGS

FIGS. 1A-1F show views of a device in a deployed configuration according to embodiments of the invention.

DETAILED DESCRIPTION OF THE INVENTION

Figure 2A:
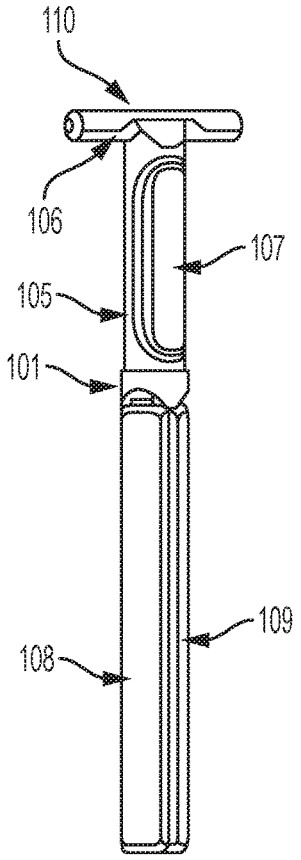
FIGS. 2A-2E show views of a device in a collapsed configuration according to embodiments of the invention.
Figure 2B:
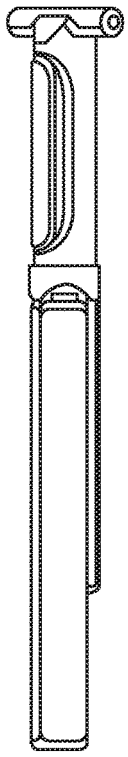
Figure 2C:
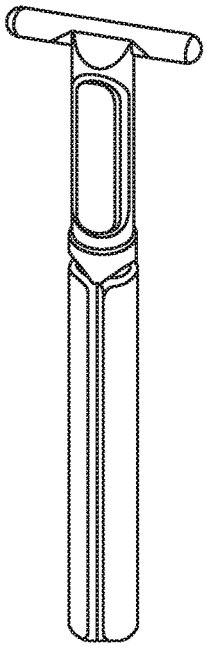
Figure 2D:
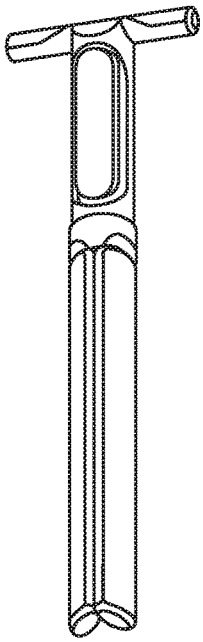

The following description is presented to enable any person skilled in the art to make and use the embodiments, and is provided in the context of a particular application and its requirements. Various modifications to the disclosed embodiments will be readily apparent to those skilled in the art, and the general principles defined herein may be applied to other embodiments and applications without departing from the spirit and scope of the disclosure. Thus, the invention is not limited to the embodiments described and shown.

A device is provided that provides the user with a secure platform to get themselves down onto the ground and back up from the ground in a safe and independent manner. The device relies on its specially designed structure to encourage the user to use large muscle groups while getting them up and down. The device allows the user to ascend from lying down to a kneeling or other intermediate position, and from the kneeling or other intermediate position to a standing position with their upper body weight forward relative to their ankles and feet, using their arms for support and balance. The device is capable of supporting users on a spectrum from very light and/or small to those of considerable weight and size. It preferably utilizes a pair of separated sloped handles at a low elevation that allow the user to gradually align their body off the ground starting with their knees, body, and/or feet positioned in a space between the handles. Beyond this, the device includes one or more intermediate handles elevated higher than the sloped handles for support and balance purposes for the second phase of getting up. The intermediate handles provide a rest spot for the user to regain their personal balance before leaving the device. The structure of the device enables it to resist horizontal and vertical displacement while being pushed and pulled on by the user in the process of ascending and descending.

A number of embodiments are provided with features applicable for different categories of use, including compact and mobile embodiments for daily personal use, rugged embodiments for extended institutional use, and embodiments for fitness and rehabilitative purposes. For example, personal use embodiments may include devices that may be folded for stowaway, and unfolded when the user will rely on its use. The device may fold into itself and can sit vertically or horizontally on the floor or be stowed on walls when it is not being used or when it is in transit between locations. Such a device can be carried and clipped onto various docks around the home for activities in places such as the bedroom, living room, kitchen, bathroom, and can be stored in the trunk of the car to bring to public places such as the grocery store or social event. As another example, embodiments for institutional use may be designed more for strength and durability in order to withstand increased usage in an assisted living environment, as compared to personal use embodiments where mobility is a priority. In still another example, embodiments for fitness and/or rehabilitative use may include additional features designed for targeting particular kinetic development and/or for integrating with other tools used in such environments.

The device enables older or physically limited individuals to reclaim the floor, letting go of the fear of getting down on the ground. With the device, older or physically limited individuals regain confidence that they can get up again based on their own physical abilities. The device not only encourages its users to engage in activities that benefit them emotionally but it also reinforces proper muscle extension that can help keep them fit and active. Fear of falling may in turn lead to increased risk of falls. This device encourages physically limited individuals to practice how to get up and down from the floor correctly while engaging the proper muscle groups. As a result, the user can in turn reduce the risk of falls and extend their mobile years. The present device empowers older or physically limited individuals to reclaim the floor space by helping them get on and off the floor confidently using their own physical abilities. It is a sturdy structure, with handles for correct hand placements to help individuals get up securely and safely on their own, which in turn will help them let go of their fear of being down on the floor. Fear may lead to avoidance of activity, which can increase the risk of falling or getting hurt due to increased immobility and physical decline.

Mobile Personal Use Embodiments

An exemplary device 100 is described with reference to FIGS. 1A-1F and 2A-2E in accordance with embodiments of the invention. In some embodiments, device 100 may have a collapsed configuration and a deployed configuration. FIGS. 1A-1F show views of device 100 in its deployed position and FIGS. 2A-2E show views of device 100 in its collapsed configuration. With reference to FIGS. 1A-1F, it can be seen that device 100 includes a base portion 101 including three support members 102, 103, and 104. In exemplary device 100, support members 102, 103, and 104 form a tripod structure to allow device 100 to stand freely on the floor or other supporting surface and support the body weight of the user. The tripod structure may also allow device 100 to resist horizontal and vertical displacement while being used by the user. It will be understood by those of ordinary skill in the art that the number and type of support members shown is not intended to be limiting and that any suitable number or type of support members may be used to allow device 100 to stand freely and support the body weight of the user and to resist horizontal and vertical displacement during use. Advantageously, a space 111 (as best seen in FIG. 1F) is disposed between support members 102, 103 into which a user can position their knees, feet and upper body at various stages of the ascending and descending process, described below. This allows the user to gradually move their knees and feet forward toward the device as they grasp handholds 107-109 until their upper body is fully supported by their legs in a standing position.

It will be understood that while device 100 is shown having three support members in a tripod-like structure, the device may have 4, 5, 6 or more such support members arrayed in a hub and spoke configuration to provide greater engagement with the floor and less spacing between support members, thereby enhancing stability. The support members may be arranged symmetrically at equal spacing between members, clustered in pairs or groups, or arranged asymmetrically with varying spacing between members or groups of members as may be desired for greater stability, ease of use, or other benefits.

Device 100 further includes a vertical member 105 that extends upwards from base portion 101 and ends at a junction with a horizontal member 106. Vertical member 105 may include a rotatable intermediate handle 107 which rotates 90 degrees from the position shown in FIG. 1C to the position shown in FIG. 1F. As best seen in FIG. 1F, in its fully deployed configuration, device 100 includes three sets of handholds: lower sloping handholds 108 and 109 disposed on support members 102 and 103 respectively, handhold 107, and handhold 110 disposed on horizontal member 106. Any or all of handholds 107-110 may be covered in a material or materials allowing for increased grip during use. For example, the handholds may be covered in a rubber-like or foam material with a texture allowing for easy and comfortable gripping during use. Sloping handholds 108, 109 are advantageously elongated and extend longitudinally up supports 102, 103 from a position near the lower end of each support to a point near the upper end of each support in a railing-like configuration, such that the user can reposition each hand in an alternating fashion in a series of increasing elevational positions along handholds 108, 109 to ascend the supports 102,103.

Figure 2E:
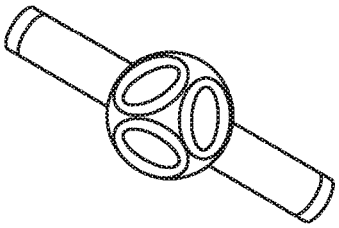
Figure 3A:
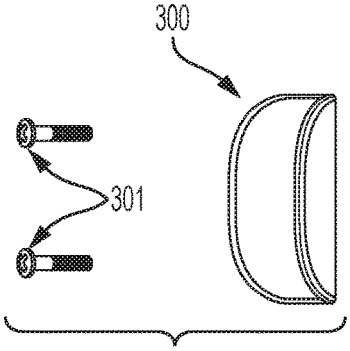
FIGS. 3A-3D show views of a mounting bracket for the device of FIGS. 1A-2F according to embodiments of the invention.
Figure 3B:
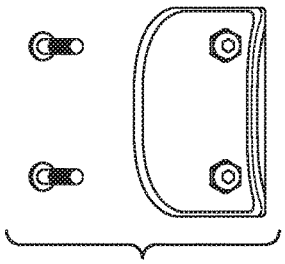
Figure 3C:
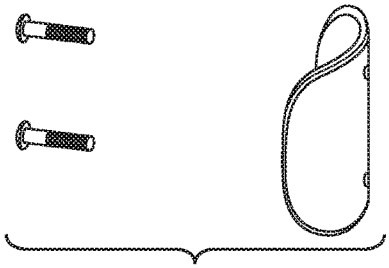
Figure 3D:
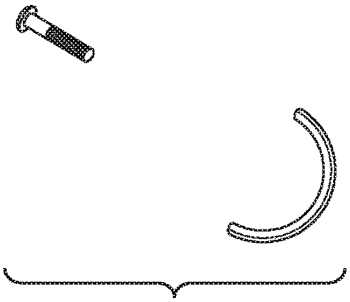

As can be seen in FIGS. 2A-2D, in the collapsed configuration, the support members 102-104 of device 100 may collapse together to allow for increased mobility and transportability of device 100 when not in use. As best seen in FIG. 2E, support members 102-104 may collapse so as not to extend outside of the profile of vertical member 105. It will be understood by those skilled in the art that any suitable mechanism may be used to allow support members to collapse as shown in FIGS. 2A-2D. For example, support members 102-104 may be rotatably coupled via any suitable mechanism to vertical member 105 in a manner that allows locking when fully collapsed and/or when fully deployed (as shown in FIGS. 1A-1F). In some embodiments, the transition to and from the deployed and collapsed configurations may be actuated by manually rotating support members. For example, in some embodiments, support members 102-104 may open out at an angle and swivel down on a hinge rotation similar to a camera tripod. In some embodiments, the transition to and from the deployed and collapsed configurations may be actuated by an actuation mechanism such as a release button that unlocks any mechanism coupling support members to the vertical member 105. Additional mechanisms for transitioning to and from deployed and collapsed configurations will be described below in accordance with some embodiments.

Figure 4:
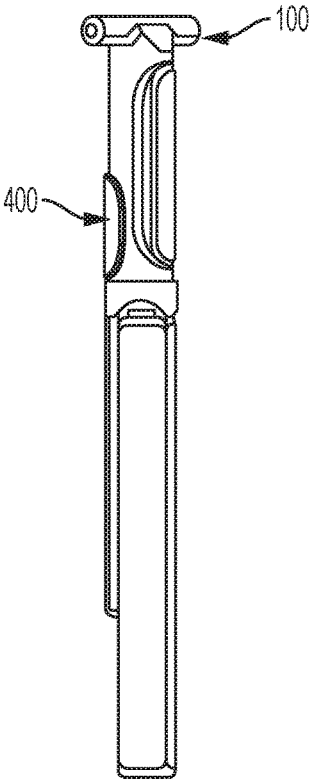
FIG. 4 shows the device of FIGS. 2A-2E mounted to the mounting bracket of FIGS. 3A-3D according to embodiments of the invention.

When in the collapsed configuration shown in FIGS. 2A-2E, it will be understood that device 100 may also be more easily stored. In some embodiments, a mounting bracket 300 as shown in FIGS. 3A-3D may be provided to allow convenient mounting of device 100 to a user's wall. FIGS. 3A-3D show views of mounting bracket 300 in accordance with embodiments of the invention. As can be seen in FIGS. 3A-3D, mounting bracket 300 may be affixed to a wall of the user's home via screws 301. In order to allow device 100 to be mounted thereto, mounting bracket 300 may include a curved structure with a shape and size complementary to vertical member 105 of device 100. For example, vertical member 105 may snap fit into mounting bracket 400, suspending it above the ground and within easy reach of a user as shown in FIG. 4. It will be understood that a user may easily install any number of mounting brackets 400 at convenient locations throughout the user's home including a living area, kitchen, restroom, bedroom, or the like. In this way, the user may have one or more devices 100 available for use when desired.

Figure 5A:
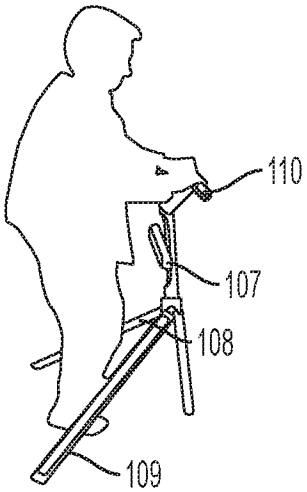
FIGS. 5A-5E show a user descending from a standing position to a kneeling position using the deployed device shown in FIGS. 1A-1F according to embodiments of the invention.
Figure 5B:
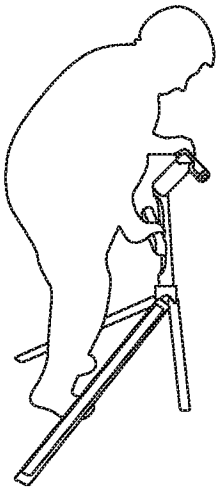
Figure 5C:
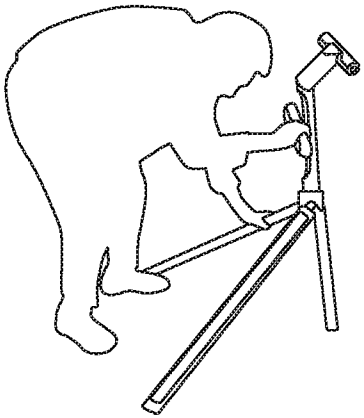
Figure 5D:
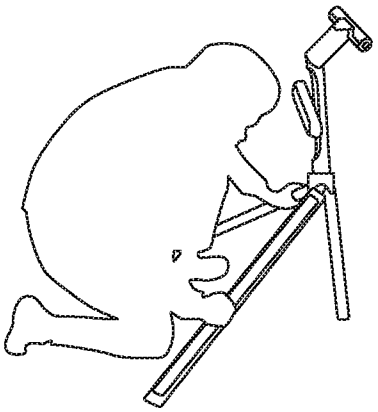
Figure 5E:
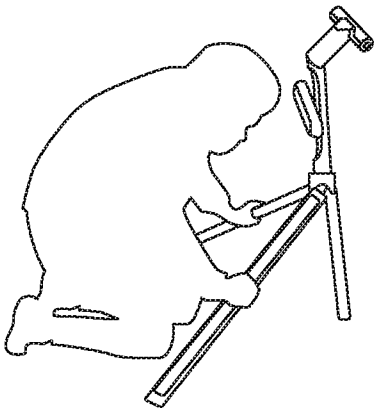

Use of a device such as device 100 to move from a standing position with a user's feet on the floor to a kneeling position with a user's knees on the floor will now be described with reference to FIGS. 5A-5E. It will be understood that the device also assists the user to move to any desired position on the floor or ground, for example, a sitting or prostrate (lying down) position. When a user wants to engage in an activity that requires getting on the ground, the user may carry device 100 to the desired location and open it into its deployed configuration (as shown in FIGS. 1A-1F). Once in place, the user may initiate her descent from the standing position shown in FIG. 5A, where one or both of the user's hands are pressing downward on handhold 110 for initial support. Next, the user may move one hand down to intermediate handhold 107 and start to bend over as shown in FIG. 5B. From this position, the second hand may be moved down to intermediate handhold 107, and a first hand may gradually descend down to an upper portion of sloping handhold 108 as shown in FIG. 5C. From this position, the user may gradually descend downward so that one knee is lowered near or onto the floor and a second hand is on an intermediate portion of sloping handhold 109 as shown in FIG. 5D. From here, the first hand may descend to the intermediate portion of sloping handhold 108 and the second knee is lowered near or on the floor as shown in FIG. 5E. The user may then gradually lower herself to the desired position on the floor by gradually moving both hands down to lower portions of sloping handholds 108 and 109 and moving her body away from device 100 as necessary. The user can then fulfill any desired tasks on the floor while keeping the device in proximity.

Figure 6A:
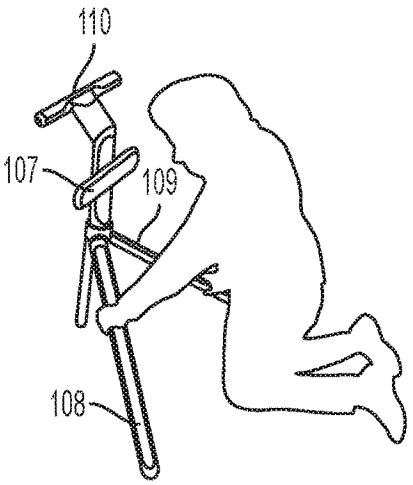
FIGS. 6A-6E show a user ascending from a kneeling position to a standing position using the deployed device shown in FIGS. 1A-1F according to embodiments of the invention.
Figure 6B:
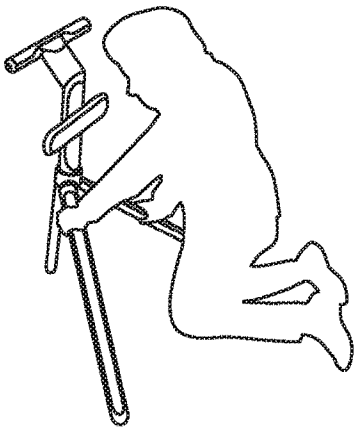
Figure 6C:
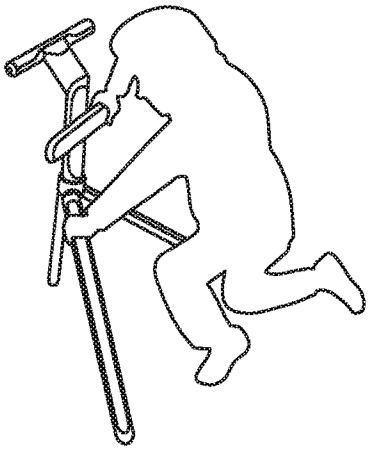
Figure 6D:
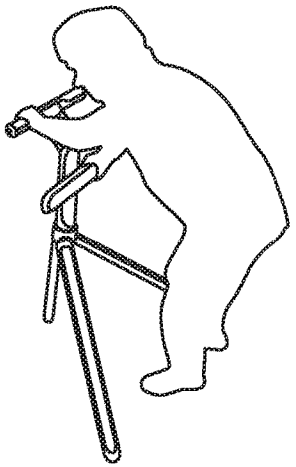
Figure 6E:
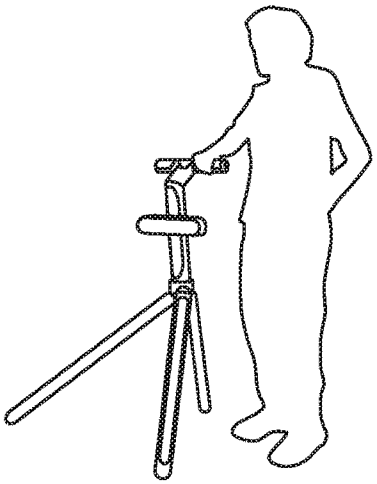

Once they have fulfilled their tasks on the floor, the user can position the device such that they are facing the device with the lower supports 102, 103 positioned symmetrically relative to their body in a position to be comfortably grasped in each hand, grasp the sloped handles, and ascend back up the device by successively grasping handholds 107-110. Use of device 100 to move from a lying down, sitting, or kneeling position to the standing position will now be described with reference to FIGS. 6A-6E. The user will first grasp the device for support, leverage, and balance to allow them to maneuver from sitting or lying down to a kneeling position. The user may initiate the ascent with both knees on the ground by grabbing at lower portions of sloping handholds 108 and 109 with both hands and gradually ascending to the upright position shown in FIG. 6A. Once at this position, the user may ascend her hands further up sloping handholds 108 and 109 to the position shown in FIG. 6B in order to position her upper body weight more over her knees and prepare to use her legs for ascending. From this position, the user may grab intermediate handhold 107 with one hand and simultaneously lift one knee up to place her foot on the ground between supports 102, 103 as she ascends to the position shown in FIG. 6C. The user may then further ascend by bringing her other hand up to intermediate handhold 107, raising her other knee so both feet are on the ground between supports 102, 103, and then ascending one hand up to handhold 110 to the position shown in FIG. 6D. During this step the user may walk further into the space between supports 102, 103 in order to position her body weight further over her ankles and feet. The user may then move the second hand up to handhold 110 for balance and bend upwards to get to an upright standing position as shown in FIG. 6E and carry on with normal activity.

As can be seen in FIGS. 5A-5E and FIGS. 6A-6E, device 100 provides many advantages in transitioning between standing and kneeling for individuals with limited mobility. First, it can be seen that the balanced structure can be simply configured to withstand the variety of horizontal and vertical forces that are imposed on it by the user's weight. The front support members 102 and 103 are configured to withstand the direct downward forces imposed on them from the user's hand pressing down. In addition, the angled configuration of support members 102, 103 translates the horizontal component of the force of the user's weight toward the rear support member 104 which is configured to withstand the horizontal forces resulting from pushing and pulling as the user ascends and descends the sloping handholds 108 and 109 and helps resist tipping or sliding. The lower ends of rear support member 104 as well as front supports 102, 103 may have a friction-enhancing surface, texture, or protruding features to engage the floor or ground and help resist slipping. Additionally, it can be seen that the sloping nature of handholds 108 and 109 allow the user to gradually ascend to/descend from a position from which the user may comfortably and appropriately begin to use the lower body to ascend/descend. The sloping nature and length of handholds 108 and 109 also provides flexibility that allows device 100 to be widely used by people with varying physical features including height, weight, strength, and general mobility. Moreover, the open space between sloping handholds 108 and 109 allows the user to keep her legs and body generally close to device 100 for increased balance while ascending and descending and increased flexibility in the manner of ascending and descending. It can also be seen that the structure of device 100 allows the user to face device 100 and reach forward for handholds 107-110 while ascending and descending, as opposed to other devices which require a user to face away and reach behind while ascending. This increases the confidence a user has in the device and improves the safety of the device by avoiding falls caused by the lack of visual confirmation of supporting structure. Having the device in front of the user is also beneficial because those with limited dexterity in the rotation of their arms are less able to use traditional devices that require them to reach behind. Finally, and most importantly, the device encourages and promotes the use of larger muscle groups to ascend and descend, namely, the use of the shoulders, legs, and glutes, among other muscle groups.

It will be understood that device 100 may be dimensioned for ease of use and comfort for a user, and to promote use of the appropriate muscle groups during ascent and descent. Specifically device 100 may be tall enough so that the user does not need to bend over to start descending, or have a bent back when the user reaches the standing position. Accordingly, in some embodiments the height of device 100 from the floor to the top of handhold 110 may range from 60 to 183 cm. In some embodiments, the height of device 100 from the floor to the top of handhold 110 may range from 60 to 148 cm, and preferably from 85 to 114 cm. Similarly, in some embodiments the height from the floor to the top of intermediate handhold 107 may range from 45 to 168 cm. In some embodiments, the height from the floor to the top of intermediate handhold 107 may range from 30 to 90 cm, and preferably from 45 to 70 cm. In some embodiments, the height from the floor to the top of sloping handholds 108 and 109 may range from 30 to 183 cm. In some embodiments, the height from the floor to the top of sloping handholds 108 and 109 may range from 23-72 cm, and preferably from 34 to 55 cm. Additionally, in some embodiments, the angles of the sloping handholds 108 and 109 in the side-side plane may range from 15° to 85°, and the angles of the sloping handholds 108 and 109 in the front-back plane may range from 15° to 85°. Moreover, in some embodiments, the length of each of sloping handholds may range from 45 to 183 cm. In some embodiments, the weight of the entire device may be made to be easily transported by a limited user, and may be less than about 25 lbs., and preferably less than about 15 lbs.

FIGS. 7A-7I show views of a device 700 in accordance with embodiments of the invention. Device 700 may operate in a manner similar to device 100 but may provide increased stability in some embodiments. Accordingly, it will be appreciated that device 700 may be dimensioned similar to device 100 above. Specifically, device 700 includes a u-shaped frame 701 which provides two vertical legs 701A, 701B on which the device may stand when in operation and a horizontal handhold 706 at the top of the device. A pivoting arm 702 is rotatably coupled to frame 701 to extend horizontally between legs 701A, 701B to form a horizontal intermediate handhold 708. A pair of legs 702A, 702B extend at an angle downwardly and outwardly from arm 702 so as to support device 700 in conjunction with legs 701A, 701B when rotated outwardly from frame 701 in a deployed configuration. Each of legs 702A, 702B has a sloping handhold 704, and 705 thereon configured to be grasped by the user's hands as they ascend or descend. Legs 702A, 702B are angled outwardly relative to each other such that the lower ends thereof are separated by a space, providing lateral stability to the device and further allowing the user to position their knees, feet or body closer to the device as they ascend so as to center their body weight more over their legs. Pivoting arm 702 may pivot around pivot points 703 so as to move from a deployed position shown in FIGS. 7A-7D to a collapsed position shown in FIGS. 7F-7I. It will be understood that pivoting arm 702 may be locked at either position by any suitable locking mechanism to ensure stability during storage and use. As can be seen in FIGS. 7A-7I, device 700 may also include a second horizontal intermediate handhold 707 between handhold 706 and 708. When in the deployed position, it can be seen that similar to device 100, device 700 thus includes multiple sets of handholds, including sloping handholds 704 and 705, and horizontal handholds 706, 707, and 708. Accordingly, device 700 may allow a user to ascend and descend in a manner similar to device 100 described above, with added stability due to the four contact points (each of legs 701A, 701B, 702A, and 702B) with the ground. And, as can be seen in FIGS. 7F-7I, device 700 may be configured to be compact in its collapsed configuration to allow for easy storage and transport similar to device 100 described above.

Figure 7A:
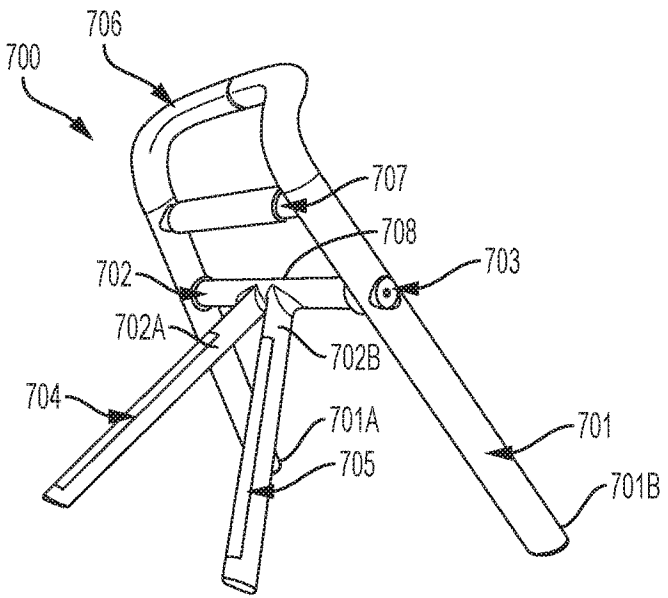
FIGS. 7A-7I show views of a device in various deployed and collapsed configurations according to embodiments of the invention.
Figure 7B:
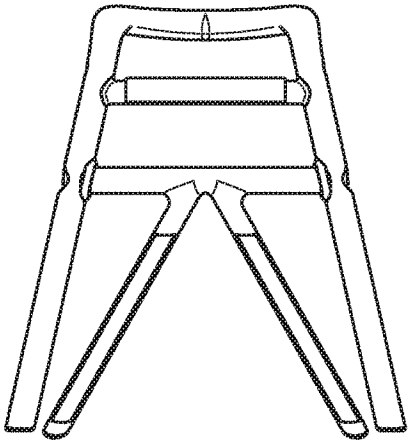
Figure 7D:
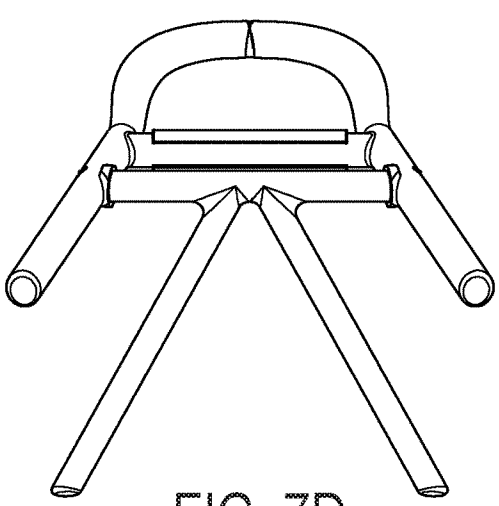
Figure 7C:
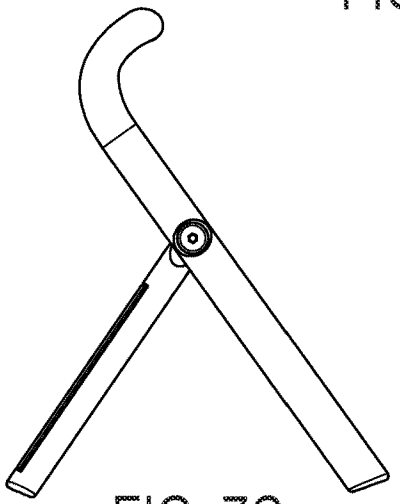
Figure 7E:
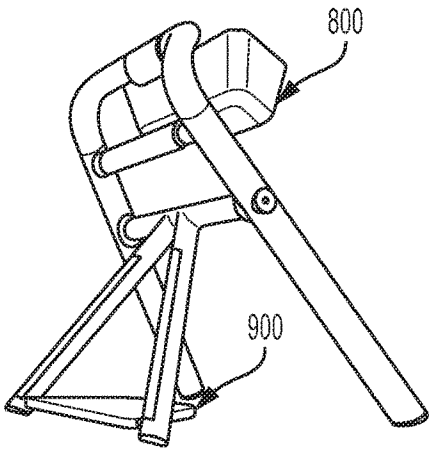
Figure 7I:
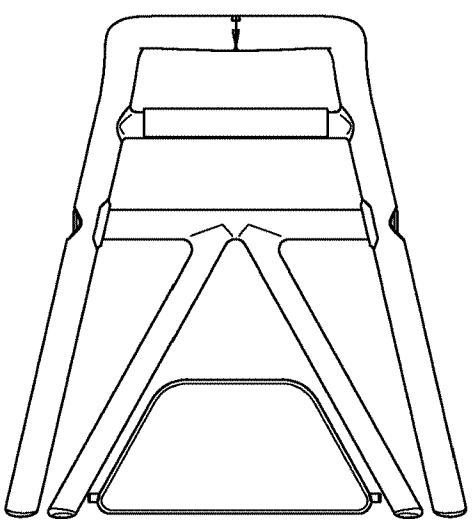
Figure 7H:
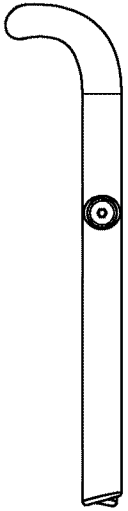
Figure 7G:
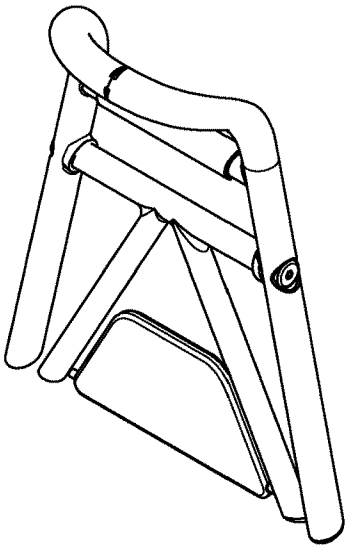
Figure 7F:
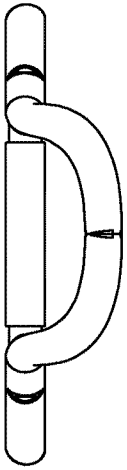
Figure 9:
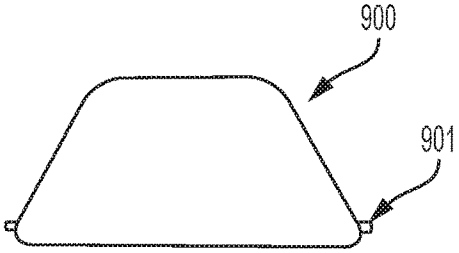
FIGS. 8 and 9 show optional accessories for use with the device of FIGS. 7A-7I according to embodiments of the invention.
Figure 8:
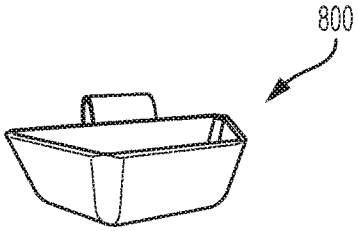

In addition, it can be seen from FIG. 7E that device 700 may include optional accessories. For example, as seen in FIG. 7E, device 700 may include optional crate 800 (shown separately in FIG. 8) which may snap fit or otherwise attach to handhold 706 to conveniently store items such as keys, phones, or other personal items of need. Additionally, as can be seen in FIGS. 7E-7I, device 700 may include an optionally integrated knee pad 900 (shown separately in FIG. 9) which may attach to legs 702A and 702B via rod 901 or other similar coupling mechanism. Knee pad 900 may provide a comfortable place to rest one or both of the users knees during use of device 700. As can be seen in FIGS. 7E, 7G, and 7I, knee pad 900 may be rotatably coupled to legs 702A and 702B so as to rotate from a deployed position on the floor as shown in FIG. 7E to a stowed position lined up with legs 702A and 702B as shown in FIGS. 7G and 7I.

As can be appreciated by one of skill in the art, both device 100 and device 700 may be suitable for personal home use, on as often as a daily basis, since they may be relatively small and light weight and collapsible to allow easy transportation even by older or physically limited individuals. Additional embodiments providing features for such personal use are described with reference to FIGS. 10-20. Although described in terms of personal use devices, it will be understood that any of these features may be incorporated in other embodiments and may find utility in embodiments for extended institutional use and embodiments for fitness and rehabilitative purposes.

Figure 10A:
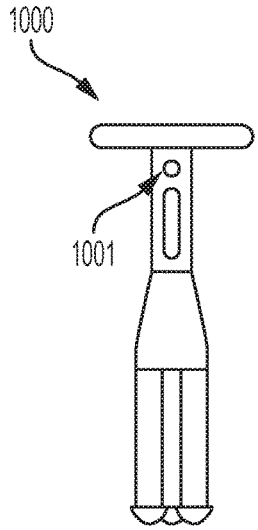
FIGS. 10A and 10B show an umbrella-like deployment device according to embodiments of the invention.
Figure 10B:
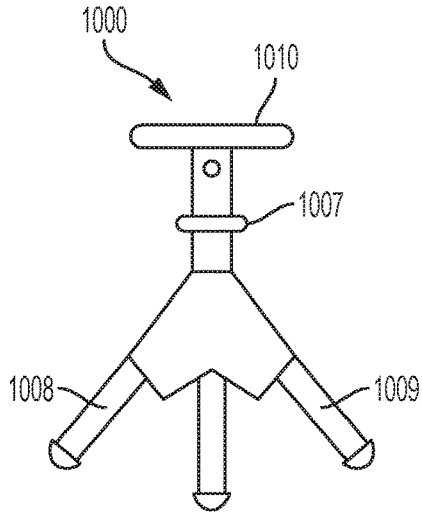

FIGS. 10A and 10B show a device 1000 with a push button umbrella-like deployment structure in accordance with embodiments of the invention. Device 1000 may have a tripod structure similar to that described above with respect to device 100. For example, as best seen in FIG. 10B, device 1000 may include sloping handholds 1008 and 1009, an intermediate handhold 1007, and a top horizontal handhold 1010 similar to the devices described above. Device 1000 may further include an actuating button 1001 which, when pressed by the user, may release the supporting members from the collapsed configuration shown in FIG. 10A to the deployed configuration shown in FIG. 10B. Supporting members of device 1000 may be held together by material 1002, which may be flexible so as to allow expansion to the deployed configuration of FIG. 10B. As can be seen in FIGS. 10A and 10B, device 1000 may operate similar to a conventional umbrella. Thus, device 1000 may be easily carried and stored when collapsed, allowing a user to take device 1000 anywhere necessary for descending to the floor and ascending back up.

Figure 11A:
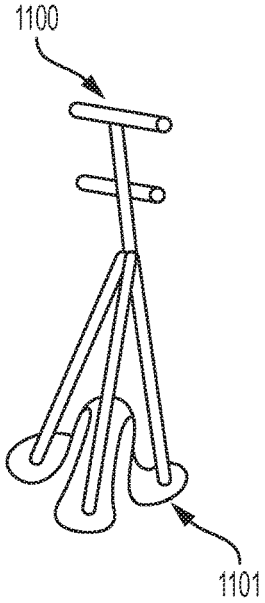
FIGS. 11A and 11B show a device with a collapsible base according to embodiments of the invention.
Figure 11B:
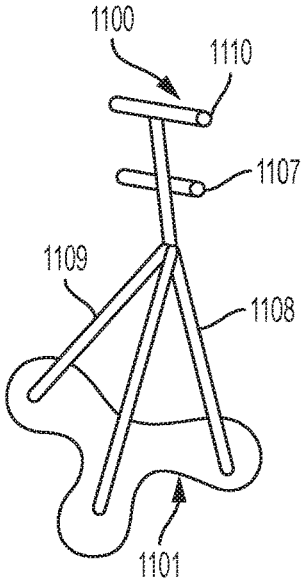

FIGS. 11A and 11B show a device 1100 with a collapsible and self-supporting base 1101 in accordance with embodiments of the invention. As can be seen in FIGS. 11A and 11B, collapsible base 1101 may be attached or otherwise integrated with supporting members of device 1100, and may compress together in the collapsed configuration shown in FIG. 11A. When opened into the deployed position shown in FIG. 11B, collapsible base 1101 may be under tension to provide increased stability. It will be understood that in some embodiments, collapsible base may be made of lightweight yet strong material with holes for support members to fit in. As such, the weight of the device may be minimized to allow for increased mobility without greatly sacrificing the strength and/or stability of the device. As can be seen in FIG. 11B, device 1100 may include sloping handholds 1108 and 1109, an intermediate handhold 1107, and a top horizontal handhold 1110 similar to the devices described above.

Figure 12A:
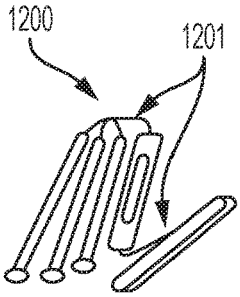
FIGS. 12A and 12B show a collapsible device with components connected by a wire according to embodiments of the invention.
Figure 12B:
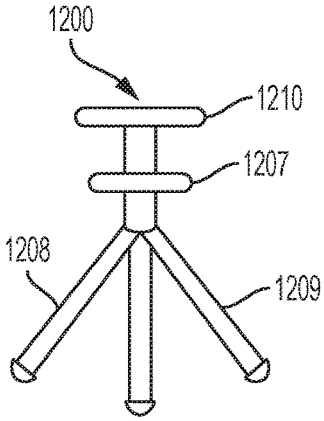

FIGS. 12A and 12B show a device 1200 in which each separate piece (including the support members, vertical members, and horizontal members) are all connected by a single wire or cable 1201 in accordance with embodiments of the invention. In the collapsed configuration as shown in FIG. 12A, the single wire 1201 is loose and the pieces may be packed together and stored in a compact pouch. When the components are pulled into the deployed positions shown in FIG. 12B, wire 1201 comes under tension and provides stability between the components, similar to the operation of a collapsible avalanche probe. As can be seen in FIG. 12B, device 1200 may include sloping handholds 1208 and 1209, an intermediate handhold 1207, and a top horizontal handhold 1210 similar to the devices described above.

Figure 14:
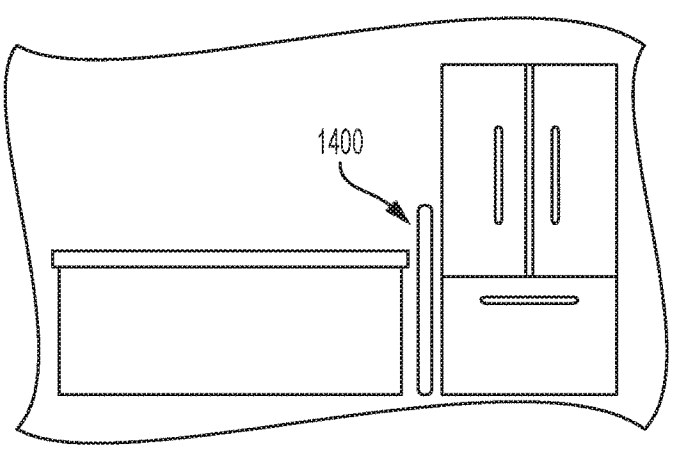
FIGS. 14 and 15 show storage of the device of FIGS. 13A-13C according to embodiments of the invention.
Figure 13C:
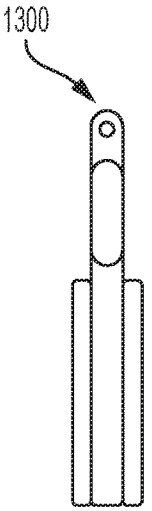
FIGS. 13A-13C show a fold-flat device according to embodiments of the invention.
Figure 13B:
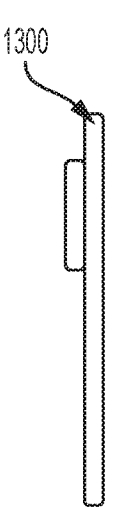
Figure 13A:
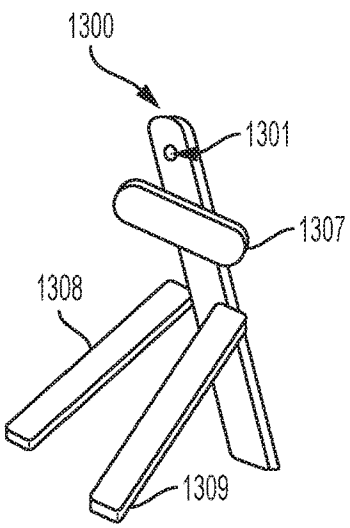
Figure 15:
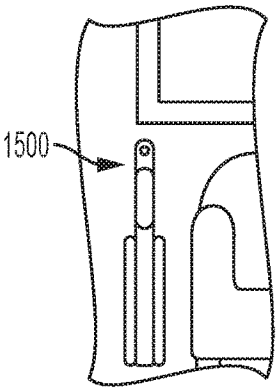

With reference to FIGS. 13A-13C and FIGS. 14-15, a folding device 1300 is described in accordance with embodiments of the invention. FIG. 13A shows device 1300 in its deployed and unfolded state which allows the user to transition back and forth between standing and a position lying, sitting or kneeling on the floor or ground, as described above with respect to devices 100 and 700. For example, as best seen in FIG. 13A, device 1300 may include sloping handholds 1308 and 1309, and a horizontal handhold 1307 similar to the devices described above. However, as shown in the side and front views of FIGS. 13B and 13C, device 1300 may be folded flat to its collapsed position to allow easy storage. For example, when folded flat, device 1300 may be stowed in a narrow household location such as next to a refrigerator as shown in FIG. 14. Alternatively, device 1300 may be hung flat against the wall by a hook or other hanging mechanism interfacing with a hole 1301 disposed on the upper portion of its vertical member as shown in FIG. 15.

Figure 16B:
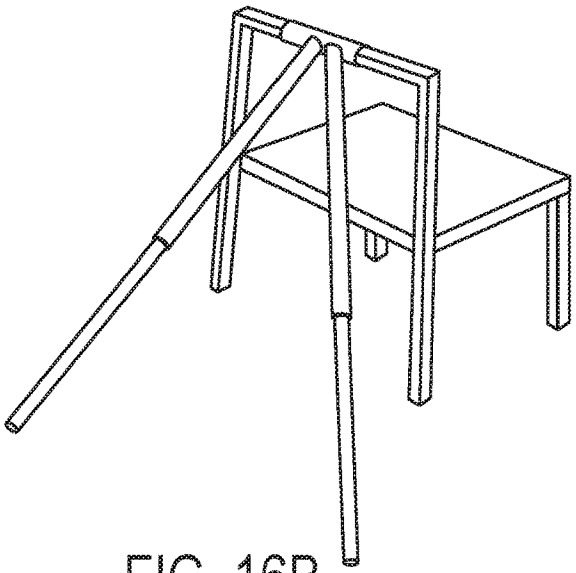
FIGS. 16A and 16B show a device integrated with a chair according to embodiments of the invention.
Figure 16A:
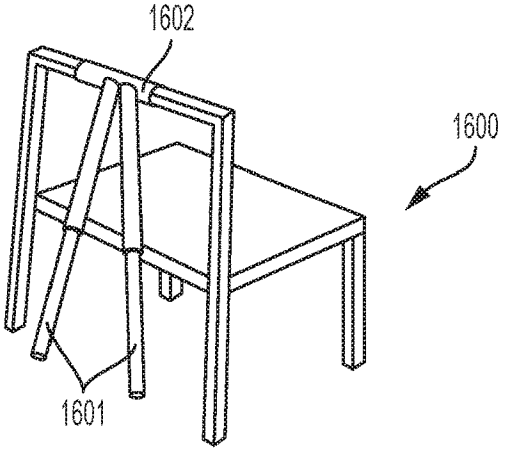

To limit the additional space utilized by a device in accordance with embodiments of the invention and to increase its functionality, it may be integrated with other household devices. For example, as shown in FIGS. 16A and 16B, a device 1600 may be integrated with a chair. As shown in FIG. 16A, the sloped handholds 1601 may be in a first retracted position lying against the back of a chair in a first configuration. When needed for ascent or descent, the sloped handholds 1601 may be retracted (manually or otherwise) as shown in FIG. 16B. Specifically, sloped handholds 1601 may be extended away from the chair by rotating member 1602 relative to the chair and then pulling sloped handholds 1602 out (in a telescoping manner) to the desired length and angle. It will be understood that the device may also be integrated into other similar furniture, such as stools, tables, couches, or other structures allowing for support and stowage of the sloping handholds.

Figure 17:
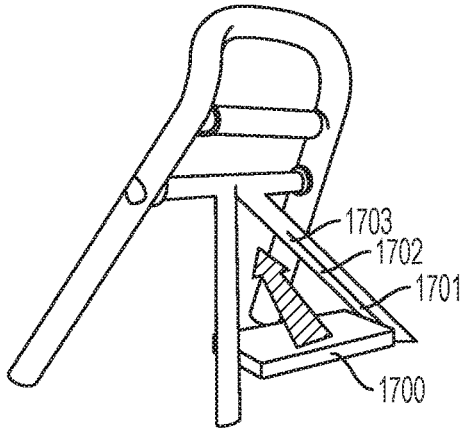
FIG. 17 shows a device with an assisting knee support according to embodiments of the invention.

In some embodiments, mechanisms may be provided to assist the user in ascending. For example, as shown in FIG. 17, a knee pad 1700 may be biased under tension such that when the user places weight on the pad 1700, the pad 1700 will provide some resistance when traveling downward to allow the user to descend slowly and safely. When the user wishes to ascend, the user may ease off the pad 1700, causing the pad 1700 to naturally rise with them and ease the user upward. The pad 1700 may travel along tracks within the legs holding the sloping handholds, and in some embodiments, may lock at fixed intervals 1701, 1702, and 1703 as shown in FIG. 17.

Figure 18A:
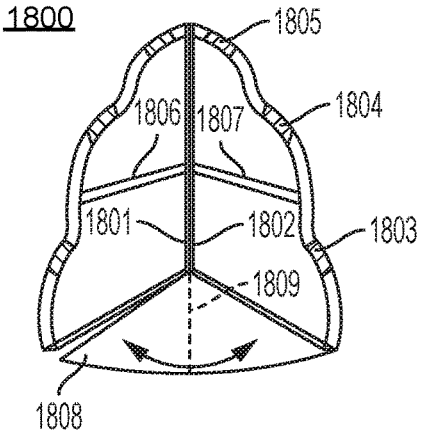
FIGS. 18A and 18B show views of an inward folding multi tiered handhold device according to embodiments of the invention.
Figure 18B:
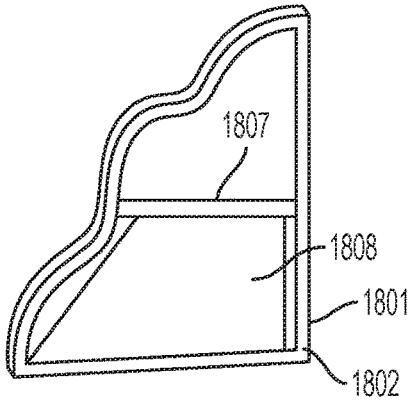

Additional mechanisms for collapsing devices in accordance with embodiments of the invention are described with reference to FIGS. 18-20. Specifically, the device shown in FIGS. 18A-18B may include a two part frame which may be folded inward and outward as indicated by the arrows to move from the collapsed to deployed configuration. For example, the device may include two L-shaped support brackets 1801 and 1802 with intermediate horizontal members 1806 and 1807 intersecting with two gradually sloping multi-tiered handhold portions that each extend from one end of the L-shaped bracket to the other as shown in FIG. 18A. As can be seen in FIG. 18A, three sloping handholds 1803, 1804, and 1805 may be provided on each side to allow the user to ascend and descend as described above. In some embodiments, a folding knee cushion 1808 may be integrated with the device. For example, the knee cushion may be integrated with the lower portion of the L-shaped bracket 1802 and may fold open at point 1809 when the L-shaped brackets 1801 and 1802 are folded outward as shown in FIG. 18A, and fold closed when the L-shaped brackets 1801 and 1802 are folded inward as shown in FIG. 18B.

Figure 19:
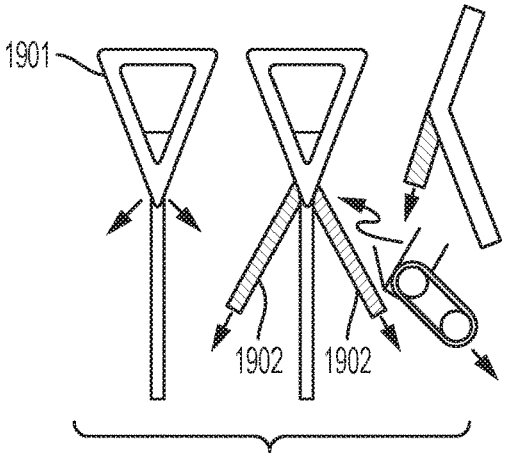
FIG. 19 shows a single-legged device with retracting additional leas according to embodiments of the invention.

FIG. 19 shows a single-legged structure with triangular upper handholds 1901 that house the additional legs 1902 with the sloped handholds. As can be seen in FIG. 19, the angled components of the triangular handholds may be hollow to encase the additional legs. To deploy the device, the additional legs 1902 may be pulled out of the hollow handholds in a telescoping manner and brought all the way out to provide support. Once deployed, the additional legs 1902 may act as the sloped handholds similar to any of the devices described above. It will be understood that the additional legs 1902 may be locked in both the collapsed position and the deployed position to ensure stability.

Figure 20:
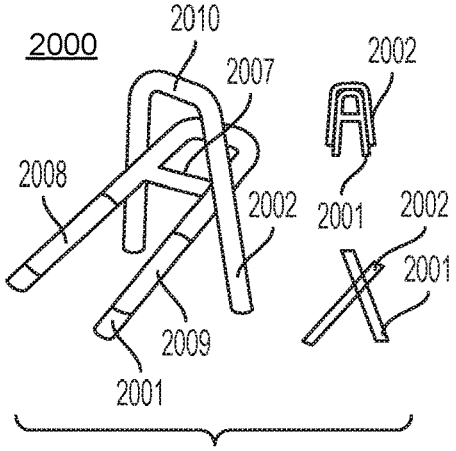
FIG. 20 shows a foldable device with an inner and outer member according to embodiments of the invention.

FIG. 20 shows another foldable embodiment of the device comprising two U-shaped members 2001 and 2002 that may pivot with respect to each other similar to device 700 described above. As shown in FIG. 20, the inner member 2001 may have the sloping handholds 2008 and 2009 when deployed, and may fold within the outer member 2002 to yield a substantially flat collapsed structure for easy storage and transport. As can be seen in FIG. 20, inner member 2001 may also have intermediate handhold 2007, and outer member may have top horizontal handhold 2010 similar to the devices described above.

It will be understood that any other suitable mechanisms may be used to allow devices with the features above to be moved between collapsed and deployed configurations, including both manual and powered mechanisms. In some embodiments, for example, a device may be provided that naturally moves from a collapsed configuration to a deployed configuration by operation of gravity on one or more components thereof.

Institutional Embodiments

In addition to personal home use, devices for assisting users in transitioning from lying, sitting or kneeling on the floor or ground to standing and vice versa can be particularly useful in institutional settings such as assisted living centers, nursing homes, or other similar settings. In addition to use by the individuals themselves as described above, such devices may be utilized by staff at such institutions in responding to fall incidents. Because staff are typically not supposed to assist in actually lifting patients who have fallen (due to safety concerns), it may be helpful for such institutions to have devices for assisting users on hand to be provided to patients who experience falls. Since these devices may be used for a wide variety of patients, and since they are typically provided by non-compromised caregivers, they may be designed more for strength and robustness. Thus, they may have wider dimension ranges and may weigh more than the personal home use devices described above. And, they may be designed without the need for collapsing since storage space may not be as big of a concern and it may be desirable to have them available in a ready-to-use configuration. Since such devices will still need to be taken to and from different locations, mobility of such devices is still desirable. Embodiments providing features for such institutional use are described with reference to FIGS. 21-24. Although described in terms of institutional use devices, it will be understood that any of these features may be incorporated in other embodiments.

Figure 21A:
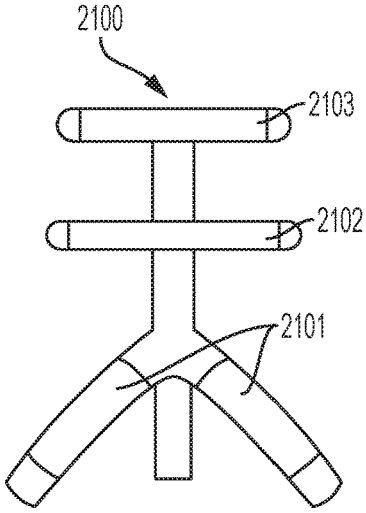
FIGS. 21A and 21B show views of a single piece device according to embodiments of the invention.
Figure 21B:
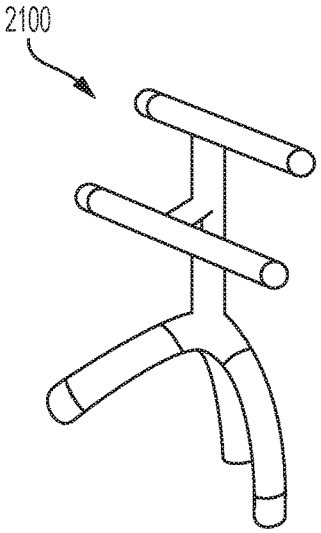

FIGS. 21A-21B show a front and perspective view of device 2100 in accordance with embodiments of the invention. As can be seen in FIGS. 21A-21B, device 2100 may have a similar structure to device 100 (in device 100's deployed form), except that device 2100 may be made of an essentially single rigid structure without moving parts or with very few moving parts. As can be seen, device 2100 may include three sets of handholds including a pair of lower sloping handholds 2101, an intermediate handhold 2102, and an upper handhold 2103 similar to the devices described above. Accordingly, device 2100 may allow a user to ascend and descend between lying, sitting or kneeling on the floor or ground and standing positions as described above. It will be understood that by limiting moving parts or connections, device 2100 may be more robust for everyday institutional use. Moreover, device 2100 may be made of a stronger than normal material since it may typically only be carried by non-compromised staff members of an institution as opposed to physically compromised users. In addition to making the device less susceptible to damage from wear, this may improve the range of patient sizes that may be accommodated by a given device 2100. As for storage, even though device 2100 may not fold together, it may be designed so that it may nest with other identical devices, (as shown, for example, in FIG. 3 thus allowing an institution to keep a number of devices 2100 together without sacrificing a great amount of space.

Figure 22:
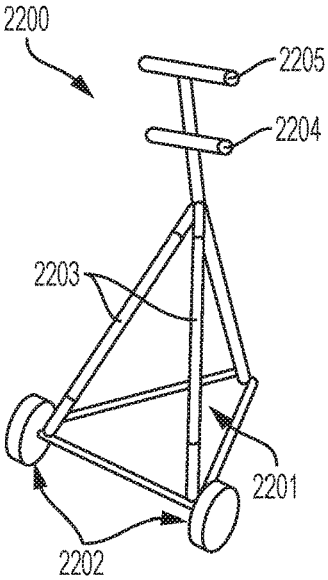
FIG. 22 shows a mobile device with a wheeled base according to embodiments of the invention.

As noted above, mobility may still be desirable in an institutional device. Accordingly, devices with increased mobility are described with respect to FIGS. 22-24. FIG. 22 shows device 2200 which has a base 2201 with wheels 2202 attached thereto. As can be seen, device 2200 also has a pair of lower sloping handholds 2203 and horizontal handholds 2204 and 2205 similar to the devices described above. Wheels 2202 may allow device 2200 to be rolled from location to location with ease, allowing the staff member to exert less energy in deploying device 2200. In some embodiments, base 2201 and wheels 2202 may be configured so that when base 2201 is resting on the ground, wheels 2202 are not in contact with the ground and device 2200 is stable. Upon tilting of device 2200 in the direction of the wheels, the wheels 2202 may engage with the ground and allow for easy rolling of device 2200. In other embodiments, wheels 2202 may be in contact with the ground when device 2200 is resting on the ground, but wheels 2202 may have a locking mechanism to prevent rolling and ensure stability during use.

Figure 23:
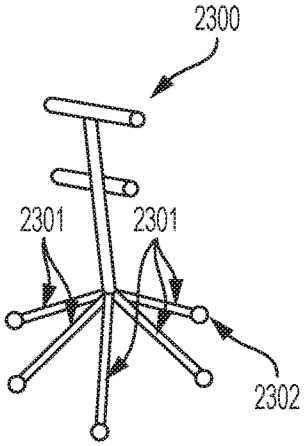
FIG. 23 shows a mobile device with a 5-legged base according to embodiments of the invention.
Figure 24:
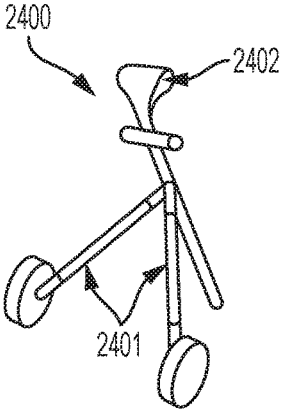
FIG. 24 shows a mobile adjustable cart device according to embodiments of the invention.
Figure 31:
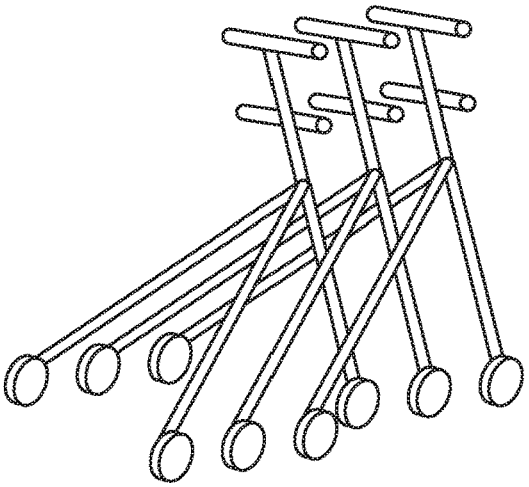
FIG. 31 shows devices nested together according to embodiments of the invention.

FIG. 23 shows a similar device 2300. Device 2300 may be a single rigid structure with five or more legs 2301 as shown. Each of the legs 2301 may have lockable wheels or casters 2302 that allow the device to be easily transported when needed. Any pair of the legs 2301 may be used as sloping handles as described above, thus allowing increased flexibility in addition to the mobility. FIG. 24 shows another similar device 2400 that may resemble a hand operated golf bag pull cart. The two sloping legs 2401 of device 2400 may have lockable wheels attached thereto to allow device 2400 to be rolled similar to the devices described above. Additionally, in some embodiments, the height of handle 2402 may be adjusted by any suitable mechanism. For example, the shaft ending in handle 2402 may telescope within hollow vertical member 2403 and may extend in and out with various locking points to allow for different heights. Furthermore, device 2400 may optionally retract by pivoting legs 2401 up to flatten with respect to vertical member 2403 and handle 2402. As described above, alternatively or additionally, device 2400 may nest with other similar devices 2400 as shown in FIG. 31 to minimize the space taken up within an institution.

Fitness and Rehabilitation Embodiments

In addition to the personal and institutional uses described above, devices assisting in transitioning from kneeling to standing and vice versa can also be utilized for fitness and rehabilitation purposes. As described above, such devices may help to teach and develop correct mechanics in moving between these positions. Accordingly, it may be beneficial to incorporate certain features for implementing such devices in these settings. Embodiments providing features for such use are described with reference to FIGS. 25-30. Although described in terms of fitness or rehabilitation devices, it will be understood that any of these features may be incorporated in other embodiments.

Figure 25A:
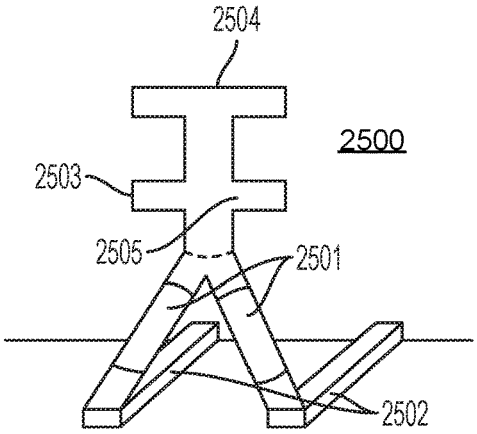
FIGS. 25A and 25B show a device integrated into a wall according to embodiments of the invention.
Figure 25B:
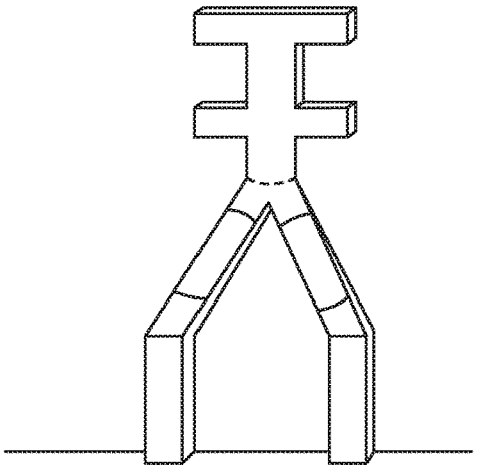

FIGS. 25A-25B show a device that may be built into the wall of a fitness or rehabilitation center in accordance with embodiments of the invention. As shown in FIG. 25A, when deployed, the device has a pair of sloping supports 2501 spaced apart from each other and coupled to supporting members 2502 by a hinged connection. Extending from another hinged connection from sloping supports is a vertical member 2505 from which a series of horizontal members 2503 and 2504 extend, providing a series handholds to allow the user to push and pull on the handholds to move from kneeling to standing and vice versa. As shown in FIG. 25B, the hinged connections of the device may be configured to allow the device to fold flat against the wall so as to be kept out of the way flat against the wall when collapsed, allowing the space to be used for other activities. In some embodiments, the handholds may be adjustable to increase or decrease the difficulty, and/or to adjust for different sized users, as might be necessary in the fitness and rehabilitation setting.

Figure 26:
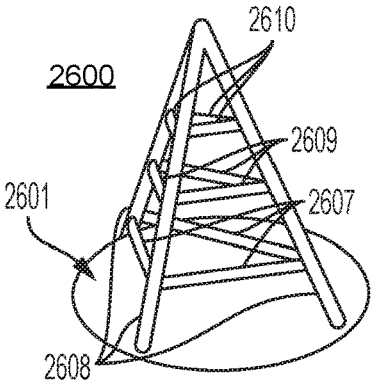
FIG. 26 shows a three-sided device with an integrated cushion according to embodiments of the invention.

FIG. 26 shows a device 2600 that may allow multiple users to practice transitioning from lying, sitting or kneeling on the floor or ground, to standing and vice versa at the same time. Such a device may include 3 or more sides as shown and may be anchored to a base or to the floor, or fixed to a common cushion, pad, or mat 2601 to anchor the legs and provide a comfortable resting point for the users' knees while kneeling. It will be understood that such a device may be helpful for use in a fall prevention class, or a class designed to help develop strength in the desired muscles. As can be seen in FIG. 26, device 2600 includes three horizontal handholds 2607, three sloping handholds 2608, three intermediate horizontal handholds 2609, and three top horizontal handholds 2610, similar to the devices described above, but allowing for multiple users at the same time.

Figure 27A:
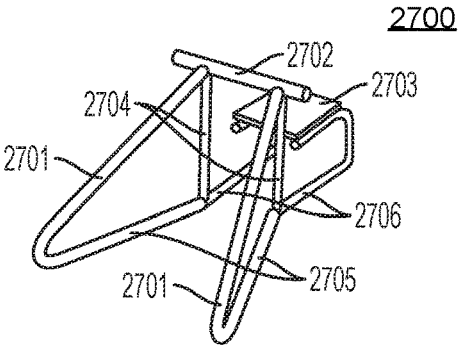
FIGS. 27A and 27B show a device with an integrated seat platform according to embodiments of the invention.
Figure 27B:
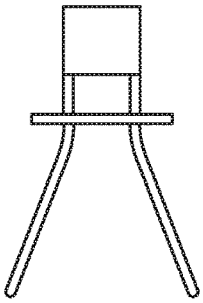

Similarly, FIGS. 27A and 27B show views of a device 2700 that includes a fitness tool that may be used in a fall prevention class. Similar to the way chairs are used a support structure to perform training exercises in fall prevention classes, device 3000 includes seat 2703 to enhance the ability of a chair structure to be used as a tool to get up and down and perform various balancing and fitness exercises to strengthen the muscles required for getting up from the floor. In some embodiments device 2700 may include one or more platforms such as seat 2703 that may aid in teaching users how to balance on a single leg, perform squats to strengthen their legs, and get up from the floor after a fall. As with previous devices, device 2700 includes a top horizontal handhold 2702 and sloped handles 2701 extending therefrom that can act as support handles at various heights to support them at all levels throughout the action of getting up and down from the ground. As can be seen in the perspective view of FIG. 27A and the top view of FIG. 27B, the distance between sloped handles 2701 may get narrower from the ground towards top horizontal handhold 2702. As can also be seen in FIG. 27A, sloping handles 2701 may be coupled to supports 2705 which may rest on the floor. Supports 2705 may also be coupled to vertical supports 2704 which provide further support for top horizontal handhold 2702. Seat 2703 may be supported by frames 2706 which extend from supports 2705.

Seat 2703 may provides added support for those that require less challenging exercises such as getting up from a seated position, using the top bar as extra support for pushing themselves up. Alternatively, the seat 2703 can be used as a lower platform of support as opposed to top horizontal handhold 2702, for pushing themselves up from the ground, or using it as support for performing squats or other exercises. Although not pictured, the platforms of such devices may be collapsible to allow the chair surface and bars to be stowed when not necessary, to gradually allow the user to wean off of the device as they become more adept and provide added challenges over time, for example.

Figure 28A:
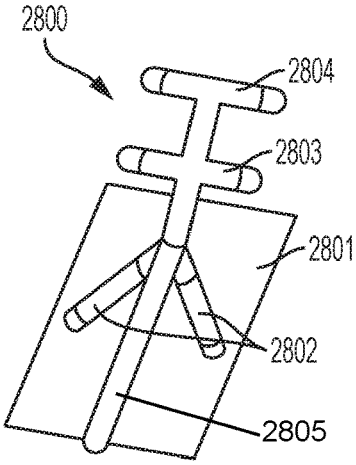
FIGS. 28A and 28B show a device with an integrated exercise mat according to embodiments of the invention.
Figure 28B:
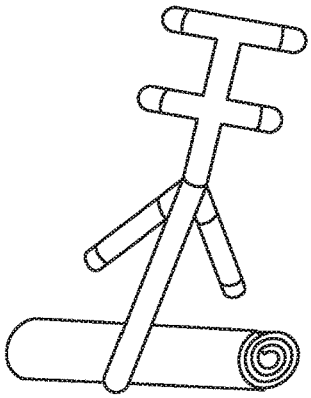

FIGS. 28A and 28B show an embodiment with a roll-out exercise mat built into the device in accordance with embodiments of the invention. Device 2800, similar to devices described above, includes a back leg 2805 and a pair of front legs with sloping handles 2802. As can be seen in FIGS. 28A and 28B, roll-out exercise mat 2801 may be integrated with or otherwise coupled to the back leg 2805 of device 2800, and may be opened as shown in FIG. 28A when in use, and rolled up as shown in FIG. 28B when not in use. As such, device 2800 may be conveniently used for assistance in performing exercise routines such as stretching, yoga, or other routines requiring transitioning from kneeling to standing and vice versa. It will be understood that although not shown in FIG. 28A or 28B, device 2800 may also further collapse similar to any of the devices described above so as to provide increased portability to and from the exercise facility.

Figure 29:
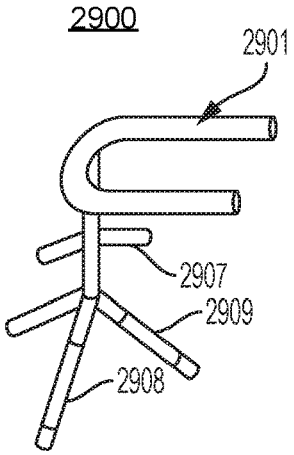
FIG. 29 shows a device with increased upper support structure according to embodiments of the invention.

FIG. 29 shows another embodiment that may be used in the fitness or rehabilitation setting. Device 2900, similar to the devices described above, includes two sloping handholds 2908 and 2909, an intermediate handhold 2907, and an upper handhold 2901. Accordingly, device 2900 operates similarly to previously described devices, except that the upper handhold 2901 is configured to wrap around the user in a U shape. Such structure may allow increased activity while standing up because it provides additional touch points and more support for the user when in the upright position.

Figure 30A:
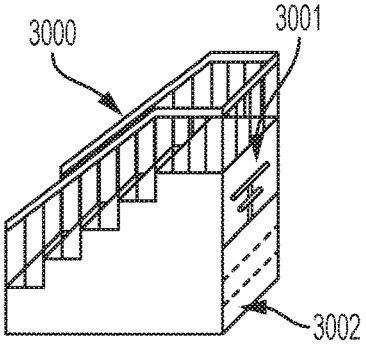
FIGS. 30A and 30B show a device integrated with a physical therapy staircase according to embodiments of the invention.
Figure 30B:
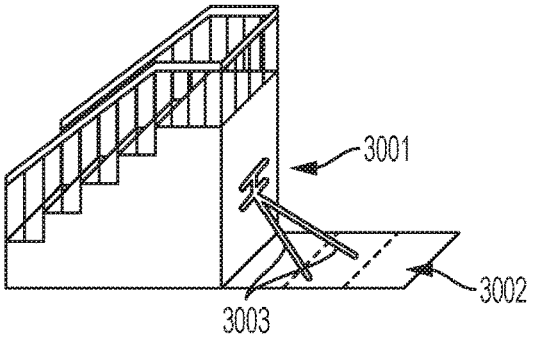

FIGS. 30A and 30B show a device 3001 similar to device 2800 with an integrated mat, except that device 3001 is further integrated with a physical therapy staircase 3000. FIG. 30A shows device 3001 folded flat against the back of staircase 3000 along with the integrated mat 3002 when not in use. FIG. 30B shows device 3001 in a deployed configuration with the integrated mat 3002 unfolded below it for support and comfort of the user. In the deployed configuration, lower sloping handholds 3003 are available for assistance in ascending and descending as described with respect to the devices above. It will be understood that device 3001 may be integrated with any other suitable physical therapy equipment to allow increased functionality and efficient use of space. For example, the device may also be integrated with a padded elevated platform that may allow a physical therapist to better assist and evaluate a patient's position, grip, balance, and/or mechanics. As another example, the device may be integrated with a lift mechanism that supports some of the users weight. For instance, the user may put on a harness that attaches to a lift disposed above the user, and the lift may have an adjustable load setting that allows the operator to adjust how much load is handled by the lift and the user. Over time, the load setting may be gradually lowered to require the user to take on more load as he becomes more capable of bearing his own weight. In addition to the equipment above, such devices may be integrated with walls (as described above), within floors (so as to be effectively pulled out of the floor, for example), and in any other structures as one of ordinary skill would understand.

Another way to efficiently use space when multiple devices as described above are needed (for example, for a fitness class or other similar bulk use) is to nest the devices. For example, FIG. 31 shows how the devices (shown for illustrative purposes with wheels) may be configured so as to be nested within each other for compact storage. As another example, the devices may nest within each other on a mobile structure that may be moved from a storage location to a desired accessible location when needed. For instance, the devices may be stacked onto a cart similar to a music stand holder and the cart may be put in storage when not needed, and brought to the desired location when needed for a given fitness class. As yet another example, the devices may be hung from a ceiling (for example of a fitness class studio) and may include a mechanism for easily lowering the devices for retrieval when needed.

Figure 32:
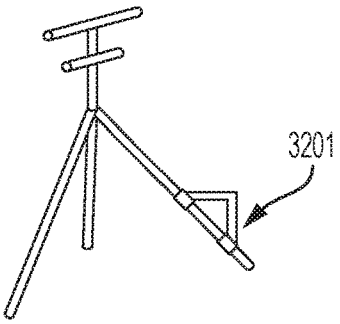
FIG. 32 shows a device with modular handles according to embodiments of the invention.
Figure 33:
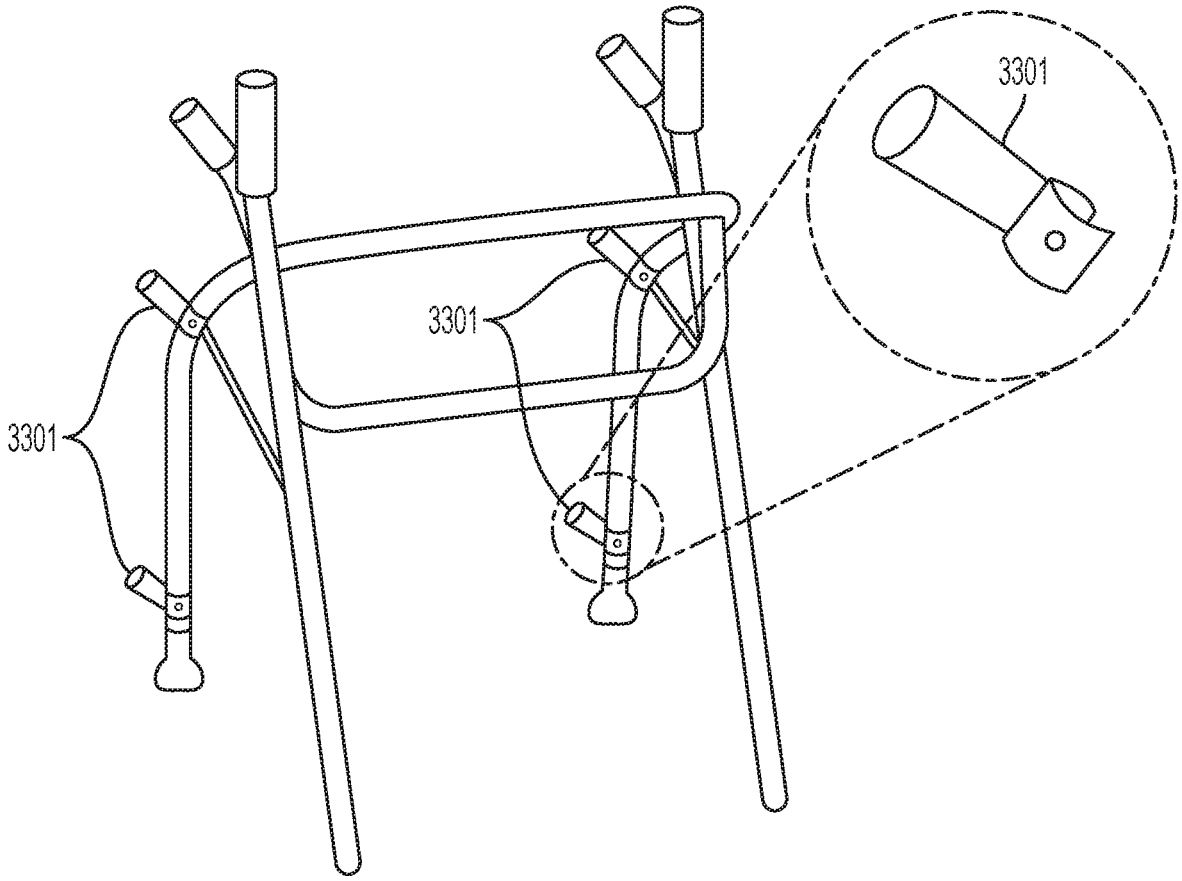
FIG. 33 shows a device with modular handles according to embodiments of the invention.

As alluded to in some instances above, it may also be beneficial to make devices for transitioning between lying, sitting or kneeling on the floor or ground and standing somewhat modular, to allow for adjustments between different users and to allow for level of difficulty adjustments for a single user. In some embodiments, the handholds themselves may be modular. For example, a detachable or movable hold 3201 as shown in FIG. 32 may be attachable to the sloping handholds at various positions to allow users with a temporary physical impairment (such as a hand injury) to practice their ability to get up and down. Multiple such holds may be attached at various positions as may suit the user. Similarly, as shown in FIG. 33, modular handholds 3301 may be removable and installable at various points on a device such as a walker (shown) to allow the device to function as an ascension/descension assist device tailored to the given user.

Although the present invention has been described in considerable detail with reference to certain preferred embodiments, other embodiments are possible. The steps disclosed for the present methods, for example, are not intended to be limiting nor are they intended to indicate that each step is necessarily essential to the method, but instead are exemplary steps only. Therefore, the scope of the appended claims should not be limited to the description of preferred embodiments contained in this disclosure. All references cited herein are incorporated by reference in their entirety.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A device for assisting a user to move between a down position in which the user is lying, sitting, or kneeling on a floor and a standing position in which the user is supported by the user's feet on the floor, the device comprising:

a first support leg and a second support leg, each having respective upper ends and lower ends, wherein the respective lower ends contact a floor when a user uses the device to move between a down position on the floor and a standing position;

a first horizontal handhold extending between the first support leg and the second support leg, and a second horizontal handhold extending between the first support leg and the second support leg, wherein the first horizontal handhold and the second horizontal handhold are substantially perpendicular to the first support leg and the second support leg;

a rotating horizontal handhold connected to the first support leg at and the second support leg at an intermediate position between the respective upper ends and lower ends of the first support leg and the second support leg, wherein the rotating horizontal handhold is substantially perpendicular to the first support leg and the second support leg;

a third support leg and a fourth support leg extending from the rotating horizontal handhold, wherein the third support leg and the fourth support leg are horizontally angled relative to each other such that a distance between a lower end of the third support leg and a lower end of the fourth support leg is greater than a distance between an upper end of the third support leg and an upper end of the fourth support leg, and wherein the third support leg and the fourth support leg are connected to the rotating horizontal handhold between a first end of the rotating horizontal handhold and a second end of the rotating horizontal handhold;

wherein the rotating horizontal handhold rotates in a first direction to cause the device to move into a collapsed configuration in which the third support leg and the fourth support leg are in-line with the first support leg and the second support leg, and wherein the rotating horizontal handhold rotates in a second direction to cause the device to move into a deployed configuration in which the third support leg and the fourth support leg are laterally spaced apart from the first support leg and the second support leg such that the device freely stands on the floor.

2. The device of claim 1, wherein the second horizontal handhold extends between the first support leg and the second support leg at a height above the rotating horizontal handhold and below the first horizontal handhold.

3. The device of claim 1, further comprising a pad material coupled to the lower ends of the third support leg and the fourth support leg, the pad material being configured to rest on the floor when the device is in the deployed position so as to provide a soft support surface for the user.

4. The device of claim 3, wherein the pad material is rotatably coupled to the third support leg and the fourth support leg such that the pad material can rotate from a first position parallel to the third support leg and the fourth support leg to a second position at an angle with respect to the third support leg and the fourth support leg, wherein the pad material rests on the floor in the second position.

5. The device of claim 1, further comprising a support locking mechanism for locking the device in the deployed configuration.

6. The device of claim 5, further comprising a release mechanism to release the device from the deployed configuration.

7. The device of claim 1, wherein the second horizontal handhold is at most about 55 cm above the floor in the deployed configuration.

8. The device of claim 1, wherein the first handhold is at least about 85 cm above the floor in the deployed configuration.

9. A device for assisting a user to move between a down position in which the user is lying, sitting, or kneeling on a floor and a standing position in which the user is supported by the user's feet on the floor, the device comprising:

a portable support structure movable from a collapsed configuration to a deployed configuration, the support structure comprising:

a first support leg and a second support leg, each having respective upper ends and lower ends, wherein the lower ends contact a floor when a user uses the structure to move between a down position on the floor and a standing position;

a first horizontal handhold and a second horizontal handhold each connected to the upper ends of the first support leg and the second support leg so as to be substantially perpendicular to the first support leg and the second support leg, wherein the second horizontal handhold is below the first horizontal handhold relative to the floor;

a rotating horizontal handhold extending between the first support leg and the second support leg so as to be substantially perpendicular to the first support leg and the second support leg, wherein the rotating horizontal handhold is connected to the first support leg and the second support leg between the respective upper ends and lower ends, and wherein the rotating horizontal handhold is below the second horizontal handhold relative to the floor;

a third support leg and a fourth support leg each connected to the rotating horizontal handhold, wherein the third support leg and the fourth support leg are laterally deployable at an angle away from the first support leg and the second support leg upon rotation of the rotating horizontal handhold toward the lower ends of the first support leg and the second support leg, wherein a lower end of the third support leg and a lower end of the fourth support leg contact the floor when deployed; and wherein the third support leg is horizontally angled outward from the fourth support leg such that the third support leg and the fourth support leg are separated by a first distance at the rotating horizontal handhold and wherein the lower end of the third support leg and the lower end of the fourth support leg are separated by a second distance that is greater than the first distance.

10. The device of claim 9, further comprising a support locking mechanism for locking the support structure in the deployed configuration.

11. The device of claim 10, further comprising a release mechanism to release the support structure from the deployed configuration.

12. The device of claim 9, wherein the second horizontal handhold is at most about 55 cm above the floor in the deployed configuration.

13. The device of claim 9, wherein the first handhold is at least about 85 cm above the floor in the deployed configuration.

14. The device of claim 9, further comprising a pad material coupled to the lower ends of the third and fourth support legs, the pad material being configured to rest on the floor when the device is in the deployed position so as to provide a soft support surface for the user.

15. The device of claim 14, wherein the pad material is rotatably coupled to the third and fourth support legs such that the pad material can rotate from a first position parallel to the third and fourth support legs to a second position at an angle with respect to the third and fourth support legs, wherein the pad material rests on the floor in the second position.

* * * * *